US007913336B2

(12) United States Patent
Morin et al.

(10) Patent No.: US 7,913,336 B2
(45) Date of Patent: Mar. 29, 2011

(54) SHEARLESS PIVOT FOR BED

(75) Inventors: Marco Morin, Breakeyville (CA); Sebastien Viger, L'Ancienne-Lorette (CA); Jonathan DesRochers, L'Ancienne-Lorette (CA); Luc Petitpas, Quebec City (CA); Steve Bolduc, Lévis (CA)

(73) Assignee: Stryker Corporation, Kalamazoo, MI (US)

( * ) Notice: Subject to any disclaimer, the term of this patent is extended or adjusted under 35 U.S.C. 154(b) by 101 days.

(21) Appl. No.: 12/191,356

(22) Filed: Aug. 14, 2008

(65) Prior Publication Data

US 2009/0044339 A1 Feb. 19, 2009

Related U.S. Application Data

(60) Provisional application No. 60/955,682, filed on Aug. 14, 2007.

(51) Int. Cl.
*A47B 7/02* (2006.01)
*A47B 7/00* (2006.01)

(52) U.S. Cl. ..... 5/617; 5/613; 5/616

(58) Field of Classification Search ..... 5/610, 611, 5/612, 613, 614, 616, 617
See application file for complete search history.

(56) References Cited

U.S. PATENT DOCUMENTS

| | | | | |
|---|---|---|---|---|
| 4,376,316 | A | 3/1983 | Mercier et al. | |
| 5,404,604 | A | 4/1995 | Has et al. | |
| 5,423,097 | A | 6/1995 | Brule et al. | |
| 5,444,880 | A | 8/1995 | Weismiller et al. | |
| 5,537,701 | A | 7/1996 | Elliott | |
| 5,577,280 | A | 11/1996 | Elliott | |
| 5,640,730 | A * | 6/1997 | Godette | 5/618 |
| 5,682,631 | A | 11/1997 | Weismiller et al. | |
| 5,870,784 | A | 2/1999 | Elliott | |
| 5,906,017 | A | 5/1999 | Ferrand et al. | |
| 5,996,151 | A | 12/1999 | Bartow et al. | |
| 6,209,157 | B1 * | 4/2001 | Hensley | 5/618 |
| 6,212,713 | B1 | 4/2001 | Kuck et al. | |
| 6,276,011 | B1 | 8/2001 | Antinori | |
| 6,393,641 | B1 | 5/2002 | Hensley | |
| 6,516,480 | B2 | 2/2003 | Elliott | |
| 6,694,549 | B2 | 2/2004 | Perez et al. | |
| 6,718,580 | B2 | 4/2004 | Heimbrock et al. | |
| 6,789,280 | B1 | 9/2004 | Paul | |
| 6,826,793 | B2 | 12/2004 | Tekulve | |
| 6,839,926 | B2 | 1/2005 | Heimbrock et al. | |
| 6,907,631 | B2 | 6/2005 | Heaton | |
| 7,017,208 | B2 | 3/2006 | Weismiller et al. | |
| 7,036,166 | B2 | 5/2006 | Kramer et al. | |
| 7,137,160 | B2 | 11/2006 | Hand et al. | |
| 7,165,277 | B2 | 1/2007 | Taguchi et al. | |
| 2002/0066142 | A1 * | 6/2002 | Osborne et al. | 5/617 |
| 2004/0103476 | A1 | 6/2004 | Barcesat | |
| 2006/0143829 | A1 | 7/2006 | Kramer et al. | |

* cited by examiner

*Primary Examiner* — Jonathan J Liu
(74) *Attorney, Agent, or Firm* — Van Dyke, Gardner, Linn & Burkhart, LLP

(57) ABSTRACT

A patient support apparatus, such as a bed, stretcher, or the like, includes a support deck with a head section pivotable between a generally flat orientation and a raised orientation. As the head section pivots from the flat orientation to an intermediate orientation, the pivot axis of the head section remains generally stationary. As the head section pivots from the intermediate orientation to the raised orientation, the pivot axis of the head section moves. The support deck may include an intermediate section attached to the head section wherein a foot end of the intermediate section moves linearly in a horizontal plane as the head section pivots from the intermediate orientation toward the raised orientation.

23 Claims, 20 Drawing Sheets

SHEARLESS PIVOT FOR BED

CROSS-REFERENCE TO RELATED APPLICATIONS

This application claims priority to U.S. provisional application Ser. No. 60/955,682, filed Aug. 14, 2007 by Marco Morin et al. and entitled SHEARLESS PIVOT FOR BED, the complete disclosure of which is incorporated by reference herein.

BACKGROUND OF THE INVENTION

The present invention relates generally to patient supports, such as those used in health care facilities, and more specifically to a pivoting assembly for a head portion of the patient support.

It is known in the prior art to provide a patient support, such as a hospital bed or stretcher, that includes a pivotable section for supporting the back and head of a patient. For example, U.S. Pat. No. 5,423,097 issued to Brule, discloses a hospital bed having a moveable upper body support. This upper body support is pivotable between a generally horizontal orientation in which the patient will be lying flat and a raised orientation in which the patient's upper body will be raised from the flat position. In many prior art beds, the pivoting of the upper body section—which is commonly referred to as the Fowler section of the bed—to and from the horizontal orientation creates shear forces between the patient and the hospital bed.

More specifically, as the Fowler section is rotated upwardly from the horizontal orientation, the patient's back and/or buttocks may be forced by the movement of the Fowler section to slide along the Fowler section and/or the seat section of the bed, respectively. This sliding motion is due to shear forces. In general, these shear forces are created because the patient's hip joint, which defines the axis of rotation for the patient's upper body, does not coincide with the axis of rotation about which the upper body section of the bed pivots. While attempts have been made in the past to mitigate these shear forces, such as by the reduced shear pivot disclosed in U.S. Pat. No. 7,017,208 issued to Weismiller, none of the prior art reduced shear pivots have offered a solution as simple, effective, and advantageous as that of the present invention.

SUMMARY OF THE INVENTION

The present invention provides an improved pivot assembly for a patient support that reduces the shear forces that would otherwise be generated between the patient support and the patient's back and buttocks. The shearless pivot of the present invention offers a simple, elegant, and effective solution to the problem of shear forces generated between a patient and the patient support.

According to one aspect of the present invention, a patient support apparatus is provided that includes a frame, a deck, a pivot axis, and an actuator. The deck is supported by the frame and is configured to support a patient. The deck includes a foot end and a head end, as well as a head section oriented adjacent the head end of the deck and a second section oriented adjacent the head section. The pivot axis enables the pivoting of the head section from a generally horizontal orientation to an intermediate orientation that defines a first angle with respect to the horizontal orientation. The pivot axis also enables the pivoting of the head section from the intermediate orientation to a raised orientation that defines a second angle with respect to the horizontal orientation wherein the second angle is greater than the first angle. The actuator is coupled to the frame and the head section and is adapted to pivot the head section about the pivot axis from the generally horizontal orientation to the raised orientation. The pivot axis remains stationary with respect to the frame while the head section pivots from the generally horizontal orientation to the intermediate orientation, and the pivot axis moves with respect to the frame while the head section pivots from the intermediate orientation to the raised orientation.

According to another embodiment of the present invention, a patient support apparatus is provided that includes a frame, a deck, a pivot axis, an actuator, a plurality of generally horizontal tracks, and a plurality of low-friction members. The deck is supported by the frame and configured to support a patient. The deck includes a foot end and a head end, along with a head section oriented adjacent the head end of the deck, an intermediate section oriented adjacent a foot end of the head section, and a third section oriented adjacent a foot end of the intermediate section. The pivot axis defines an axis about which the head section is able to pivot from a generally horizontal orientation to a raised orientation. The actuator is coupled to the frame and the head section and is adapted to pivot the head section about the pivot axis from the generally horizontal orientation to the raised orientation. The plurality of generally horizontal tracks are fixedly attached to the frame. The plurality of low-friction members are coupled to the intermediate section. The low-friction members are adapted to translate horizontally in the tracks as the head section is pivoted from the generally horizontal orientation to the raised orientation.

According to another aspect of the present invention, a method of pivoting a head section of a patient support about a pivot axis from a horizontal orientation to a raised orientation is provided. The method includes maintaining the pivot axis in a stationary position as the patient support pivots from the horizontal orientation to an intermediate orientation wherein the intermediate orientation is defined between the generally horizontal orientation and the raised position. The method further includes moving the pivot axis vertically upward as the head section pivots from the intermediate orientation to the raised orientation.

According to various other aspects of the present invention, the intermediate orientation may have an angular measure of between 5 and 50 degrees with respect to the horizontal, although the design of the patient support apparatus can be modified in accordance with the principles of the present invention to include angles outside this range. The pivot axis may move upwardly from the frame and away from the second section of the deck toward the head end as the head section is pivoted from the intermediate orientation to the raised orientation. The head section may further include one or more extensions with each extension having a slot defined therein. A pin attached to the intermediate section of the deck may be inserted through each of the slots and engage an edge of the slot when the head section is pivoted to the intermediate orientation or a higher orientation. A finger may selectively limit movement of the pin within the slots when the head section has been pivoted to or past the intermediate orientation. The finger may be rotatably coupled to one of the extensions and may include a biasing spring. The finger may further include a lever arm that contacts an abutment on the frame.

The various aspects of the present invention provide a patient support surface with a pivotable head section that pivots in a manner that causes a reduced level of shear forces to be generated between the patient and the back and seat sections of the patient support. The patient support apparatus of the present invention provides a robust, stable, and user-friendly method and structure for pivoting the head section of a patient support apparatus. These and other advantages of the present invention will be apparent to one skilled in the art in light of the following written description and the accompanying drawings.

DETAILED DESCRIPTION OF THE INVENTION

Figure 1:
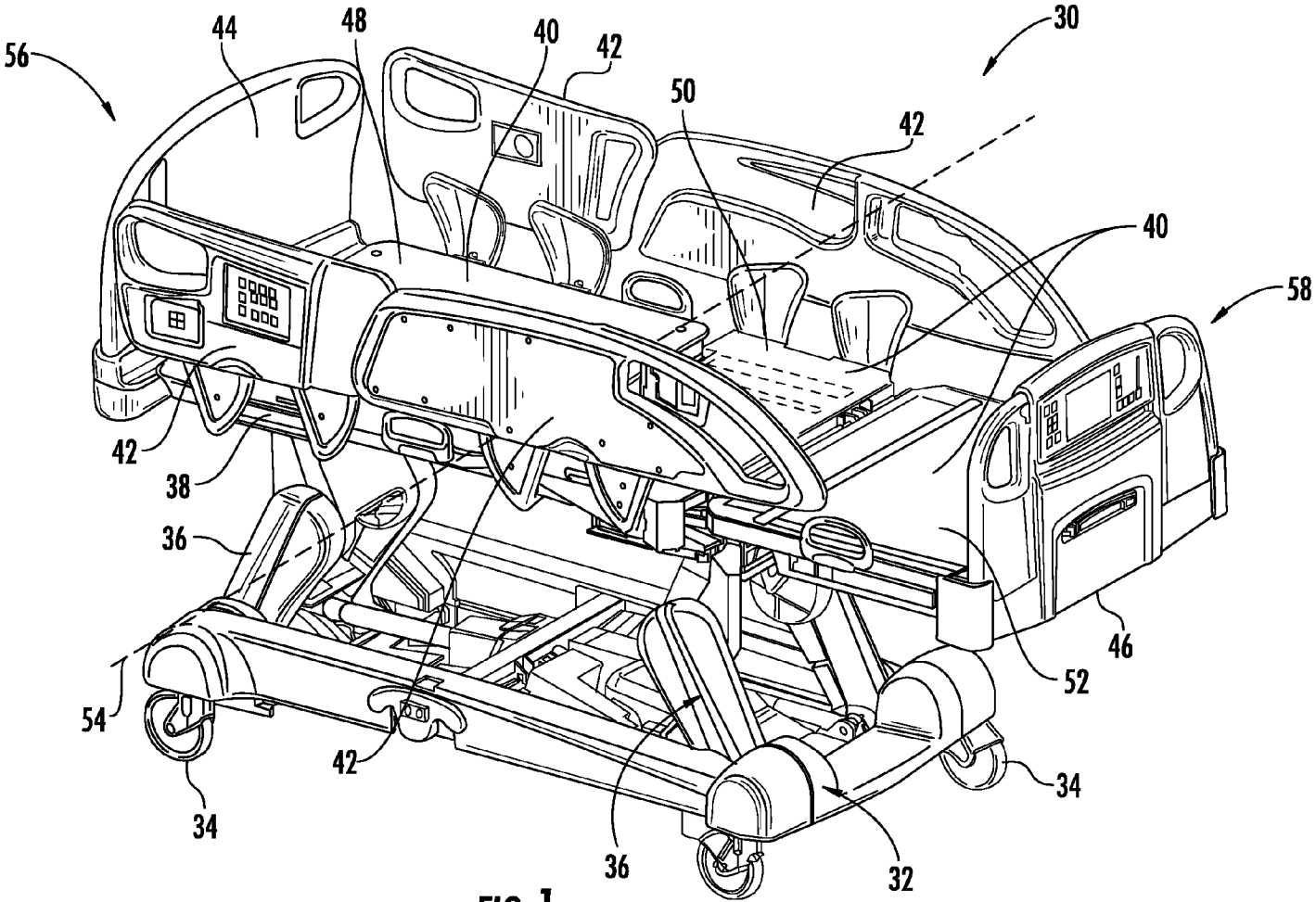
FIG. 1 is perspective view of a patient support apparatus according to one aspect of the present invention.

The present invention will now described wherein the reference numerals appearing in the following written description correspond to like-numbered elements in the several drawings. A patient support apparatus 30 is depicted in FIG. 1. Patient support apparatus may be a hospital bed, stretcher, or other type of device that supports a patient in a healthcare or nursing home type of setting. Patient support apparatus 30 includes a base 32 having a plurality of wheels 34 that allow the patient support apparatus 30 to be easily transported from one location to another. In addition to base 32, patient support apparatus 30 further includes a pair of elevation adjustment mechanisms 36, a frame 38, a deck 40, a plurality of siderails 42, a headboard 44, and a footboard 46. Elevation adjustment mechanisms 36 allow frame 38 and deck 40 to be raised and lowered to different heights with respect to base 32. Deck 40 is divided into a plurality of sections, including a head or Fowler section 48, a seat section 50, and a foot section 52. The different sections of the deck 40 are adapted to support a mattress or other type of cushioned surface on which a patient may sit or lie down.

The detailed construction of one embodiment of patient support apparatus 30 is described in commonly-assigned, copending U.S. patent application Ser. No. 11/612,361, filed Dec. 18, 2006 and entitled Hospital Bed, the complete disclosure of which is incorporated herein by reference. It will be understood that the present invention is applicable to patient support apparatuses having a wide variety of different configurations, designs, features, and constructions than what is illustrated in FIG. 1.

Head section 48 of deck 40 is pivotable about a generally horizontal axis 54 that is oriented perpendicularly to the longitudinal extent of support apparatus 30. By longitudinal extent, it is meant the extent of support apparatus 30 in the direction extending from a head end 56 to a foot end 58. Pivot axis 54 enables head section 48 to pivot so that a patient can be moved from an orientation in which the patient is entirely lying flat to an orientation in which the patient is partially or fully sitting up.

The pivoting of head section 48 about pivot axis 54 is carried out by a pivot assembly that may take on various forms in accordance with the present invention. Two different versions of the pivot assembly will be described and discussed herein. The first one is illustrated in FIGS. 2-8. The second one is illustrated in FIGS. 9-22. In both of these pivoting assemblies, head section 48 pivots upwardly from a generally flat orientation to a raised orientation, which may go as high as 70-90 degrees with respect to horizontal. As head section 48 pivots toward its maximum raised orientation, it passes through an intermediate orientation. During the pivoting from the horizontal orientation to the intermediate orientation, pivot axis 54 remains stationary. During pivoting from the intermediate orientation to the completely raised orientation, pivot axis 54 moves upwardly and along an axis extending from head end 56 to foot end 58. Generally speaking, the intermediate orientation may be defined at approximately 20 degrees, such as twenty-one degrees, although various forms of the present invention can be practiced with an intermediate orientation substantially different, such as, but not limited to, orientations of 0 to 50 degrees. The movement of pivot axis 54 after the intermediate orientation has been achieved reduces the shear forces applied to a patient, thereby making the movement of the patient more comfortable and requiring less re-adjustment of the patient.

Figure 2:
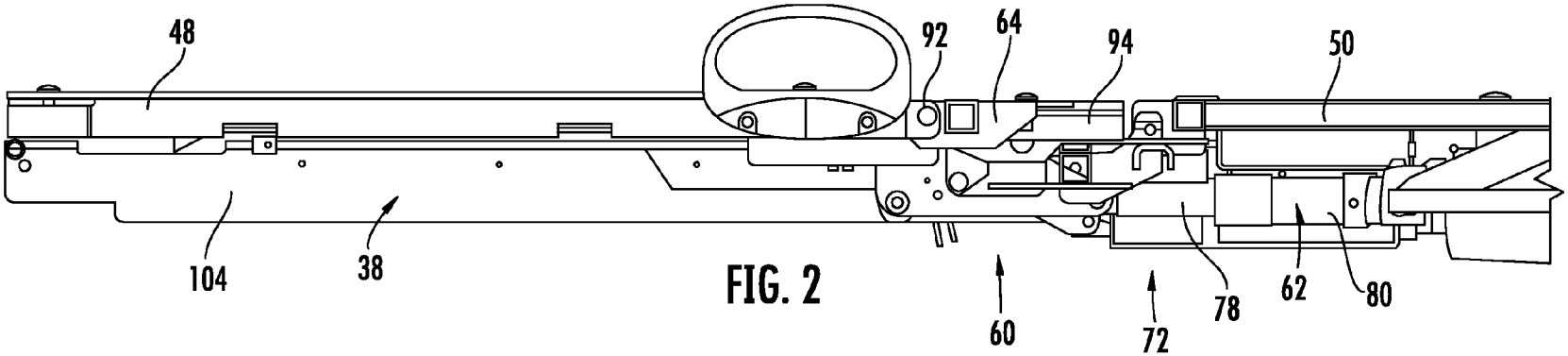
FIG. 2 is a partial, elevational view of a pivoting assembly for a head section of a patient support according to a first embodiment of the present invention.
Figure 3:
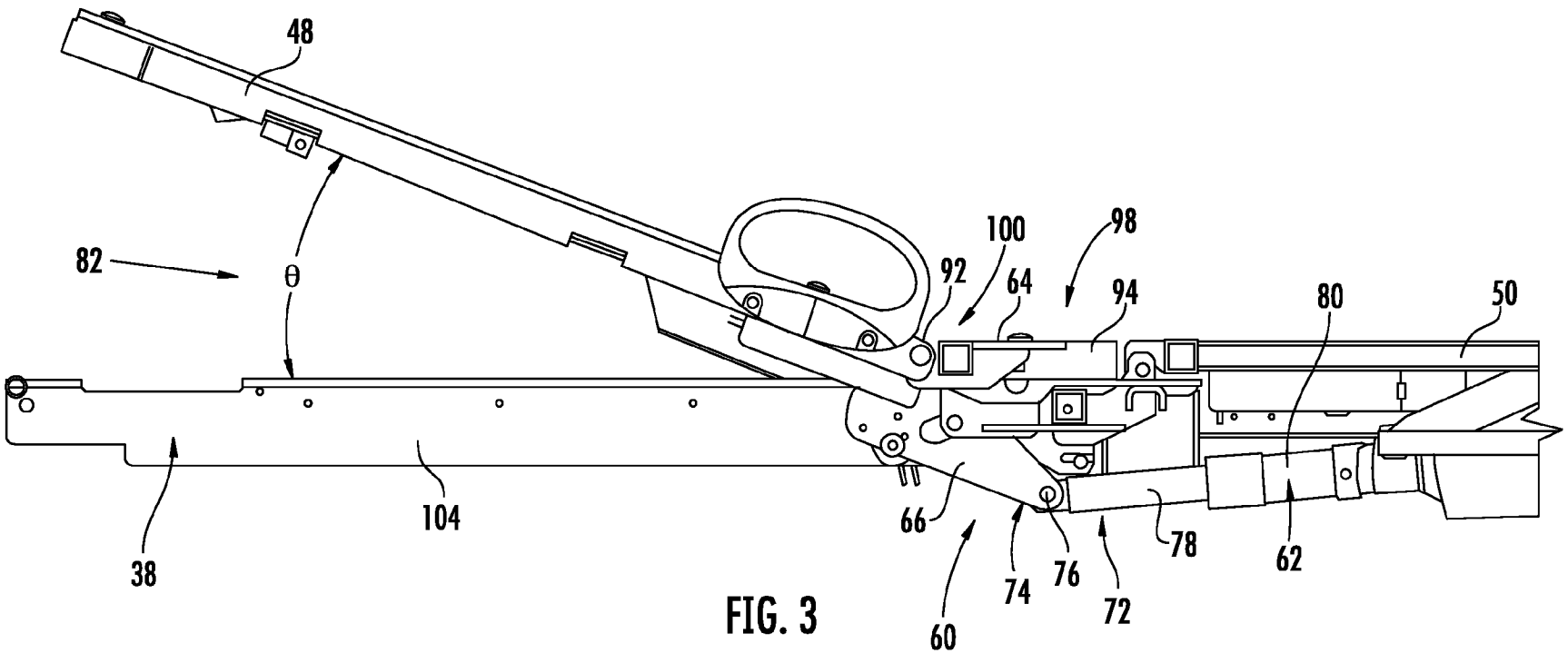
FIG. 3 is a partial, elevational view of the pivoting assembly of FIG. 2 shown pivoted to an angle of approximately twenty degrees.

A pivot assembly 60 according to a first embodiment of the present invention is depicted in FIGS. 2-8. Pivot assembly 60 generally includes pivot axis 54, an actuator 62, an intermediate deck section 64, one or more extensions 66, a pair of links 68, and a stopper or pin 70. Actuator 62 is coupled at a foot end (not shown) to a fixed location on frame 38 of support apparatus 30. A head end 72 of actuator 62 is pivotally coupled to a foot end 74 of extensions 66 by way of a pin 76. Actuator 62 includes a telescoping member 78 that slidably expands out of, or contracts into, a base portion 80. As telescoping member 78 extends out of base portion 80, it pushes against foot end 74 of extension 66. This causes head section 48 to rotate about pivot axis 54. Pivot axis 54 remains in a stationary location as head section 48 is initially pivoted from a horizontal orientation to an intermediate orientation 82. One example of such an intermediate orientation 82 is depicted in FIG. 3.

As can be seen in FIG. 3, head section 48 has been pivoted to an intermediate orientation 82 that defines an angle theta (θ) with respect to the horizontal. As noted above, the angle theta can vary greatly within the scope of the present invention. One suitable value for theta is 21 degrees. However, theta can be varied within the scope of the present invention to an angle anywhere from 0 degrees to up to 50 degrees, or more. (When theta is set to zero degrees, pivot axis 54 does not remain stationary for any portion of the pivoting of head section 48 from the horizontal orientation to the raised orientation).

After actuator 62 has rotated head section 48 up to intermediate orientation 82, any further extension of telescoping member 78 and actuator 62 will cause the location of pivot axis 54 to change as head section 48 is rotated further upward. This change in the location of pivot axis 54 results because of the interaction of stopper 70 with a pair of slots 84 defined in extensions 66. More specifically, slots 84 each include a head edge 86 and a foot edge 88. Foot edge 88 is more clearly illustrated in FIG. 2A. When head section 48 is oriented in the horizontal orientation (FIG. 2A), stopper 70 is positioned within slots 84 generally adjacent head edge 86. As head section 48 pivots upwardly, the movement of extension 66 causes the location of stopper 70 to shift within slots 84 toward foot edge 88. When head section 48 reaches intermediate orientation 82, foot edges 88 of slots 84 will come into contact with stopper 70. This contact will force stopper 70 to move with extensions 66 as head section 48 is pivoted further upwardly from intermediate orientation 82.

Figure 2A:
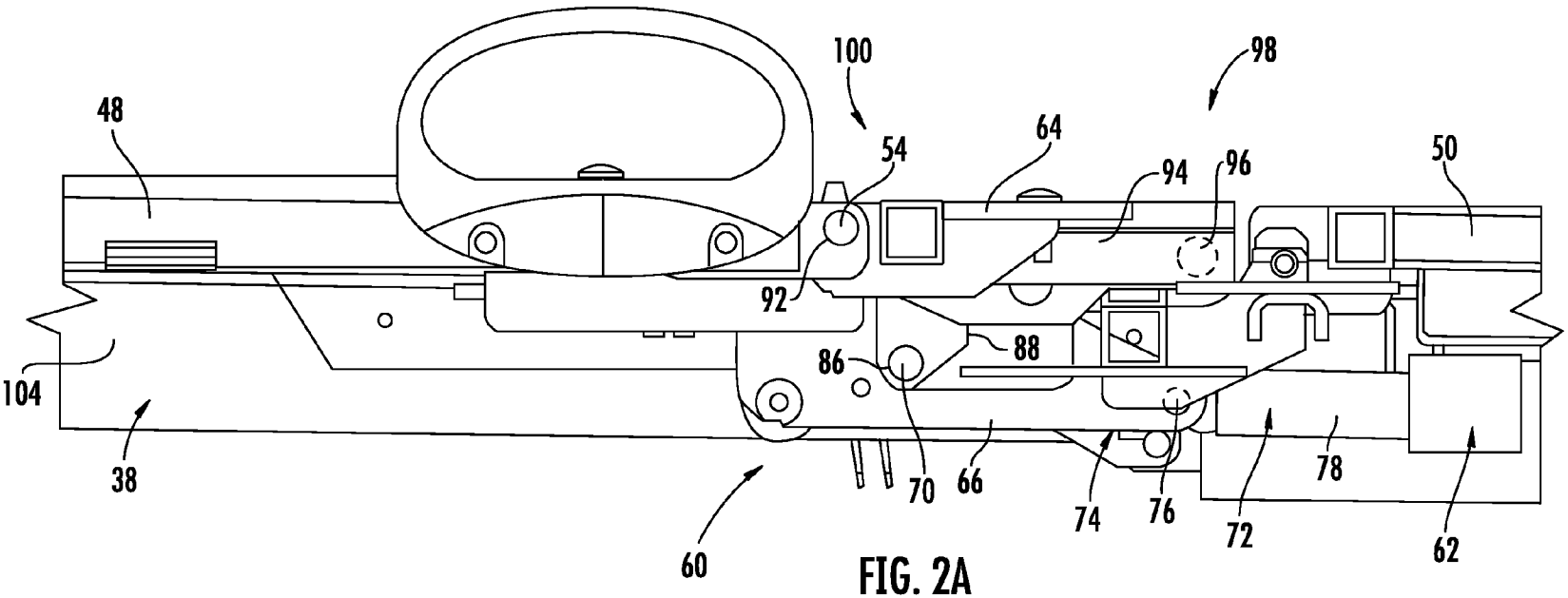
FIG. 2A is an enlargement of a portion of FIG. 2 illustrating more clearly some of the detail of the pivoting assembly.
Figure 4:
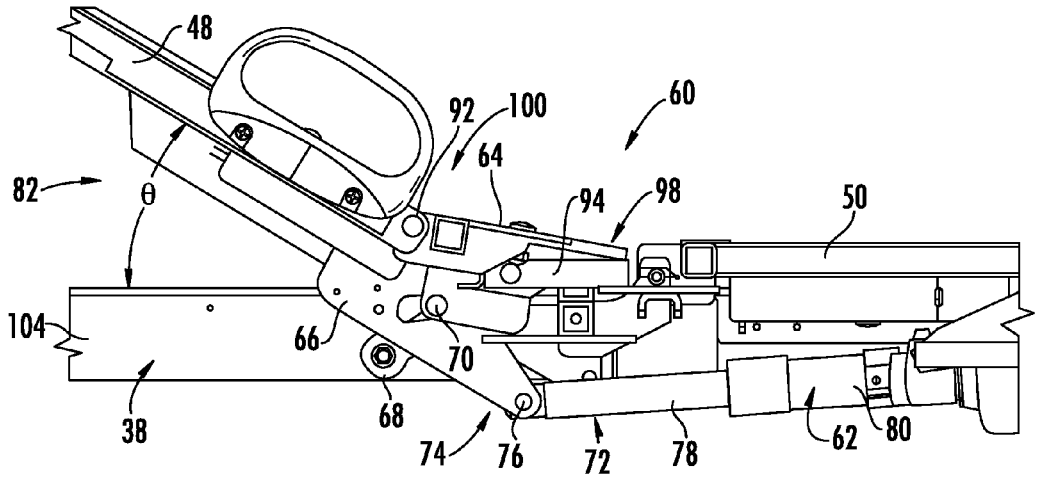
FIG. 4 is a close-up view of the pivoting assembly of FIG. 2 shown in an orientation of greater than twenty degrees but less than forty degrees.
Figure 5:
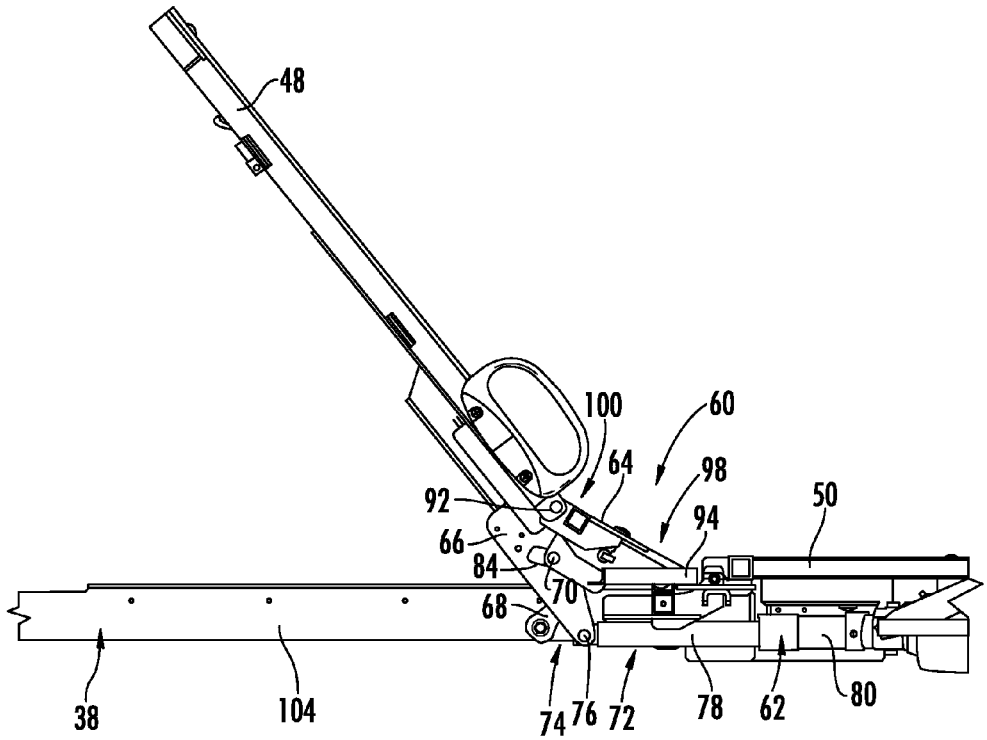
FIG. 5 is a partial, elevational view of the pivoting assembly of FIG. 2 shown pivoted to an angle of approximately forty degrees.
Figure 6:
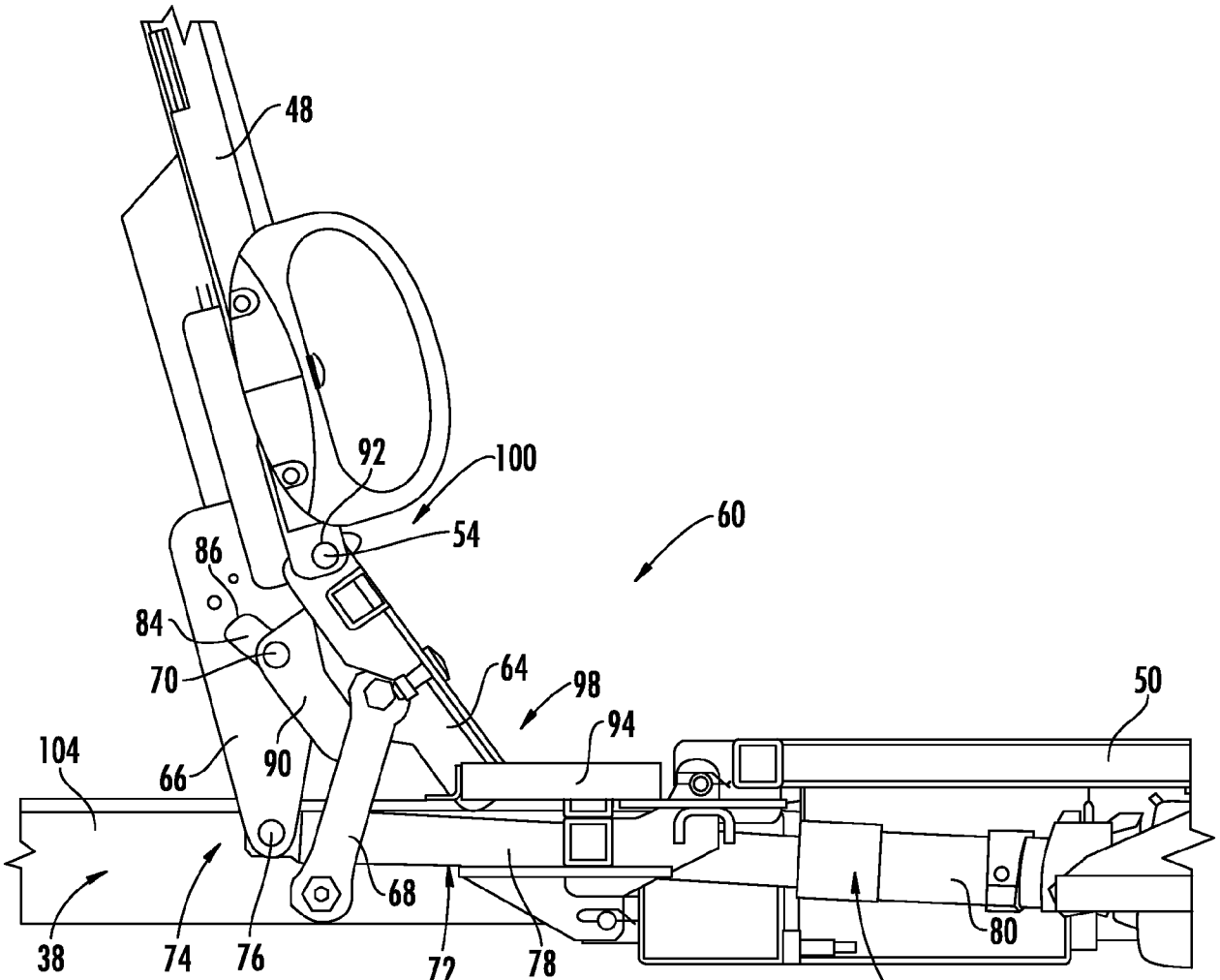
FIG. 6 is a partial, elevational view of the pivoting assembly of FIG. 2 shown pivoted to an angle of approximately fifty degrees.

The movement of stopper 70 as head section 48 pivots upwardly from intermediate orientation 82 is illustrated more clearly in FIGS. 4, 5, and 6. In FIG. 4, which depicts head section 48 in an orientation having an angle theta that is greater than the angle of intermediate orientation 82, stopper 70 has moved vertically and to the left (towards head end 56) from the position occupied prior to coming into contact with foot edge 88 (such as shown in FIG. 2). In FIG. 5, which depicts head section 48 raised upwardly to an even greater angle than that of FIG. 4, stopper 70 has moved vertically upward an even greater amount than illustrated in FIG. 4. FIG. 6 illustrates head section 48 rotated to an even greater angle than that depicted in FIG. 5, and, as can be seen, the position of stopper 70 has moved further upward.

The changing position of stopper 70 as head section 48 is rotated from intermediate orientation 82 to a higher orientation causes intermediate deck section 64 to also change its position and orientation. Stopper 70 is fixedly attached to a pair of plates 90 (one shown in FIGS. 7 and 8) that extend vertically downward from an underside of intermediate deck section 64. Plates 90 are fixedly secured to intermediate deck section 64. As a consequence, any movement of stopper 70 will cause a corresponding movement of intermediate deck section 64. Intermediate deck section 64 is pivotally attached to head section 48 by way of a pair of pins 92 (FIG. 8). Pins 92 have a longitudinal extent that generally defines horizontal pivot axis 54. Consequently, when foot edges 88 of slots 84 engage stopper 70, the subsequent motion of stopper 70 will cause intermediate section 64 to change position. This change of position of intermediate deck section 64 will cause a change in the location of pin 92, as well as pivot axis 54. Thus, when head section 48 pivots upwardly beyond intermediate orientation 82, the interaction of stopper 70 within slots 84 will cause horizontal pivot axis 54 to change its location. The change in location of pivot axis 54 as head section 48 is pivoted upwardly from intermediate orientation 82 is illustrated in FIGS. 4, 5, and 6. In general, pivot axis 54 moves vertically upward and towards head end 56 of patient support apparatus 30.

As stopper 70 engages foot edge 88 of slot 84, any further upward pivoting of head section 48 will cause stopper 70 to move vertically upward and toward head end 56. The movement of stopper 70 will, in turn, cause a corresponding movement of intermediate deck section 64 that has a horizontal component. The horizontal movement of intermediate deck section 64 is made possible by a pair of tracks 94 (one shown in FIG. 6) defined in either side of frame 38 of patient support apparatus 30. Intermediate deck section 64 includes a roller 96 (FIG. 7) attached on either of its sides that rides in tracks 94. Tracks 94 are oriented generally parallel to each other and in a horizontal orientation. Roller 96 is attached to intermediate deck section 64 generally adjacent a foot end 98 of intermediate deck section 64. As head section 48 pivots upwardly from intermediate orientation 82, intermediate deck section 64 moves away from seat section 50 of deck 40. In the illustrated embodiment, this movement of intermediate deck section 64 away from seat section 50 creates a gap between these two sections. This gap, however, is relatively small and does not create any undesirable consequences. If desired, intermediate deck section 64 or seat section 50 could be modified to include an extension that provided support for a mattress positioned on top of the region between intermediate deck section 64 and seat section 50 in order to fill in this gap. However, such an extension is not necessary.

As intermediate deck section 64 moves toward head end 56 and away from seat section 50, a head end 100 of intermediate deck section 64 will be raised vertically upward by way of the pivotable connection between intermediate deck section 64 and head section 48, as defined by pins 92.

Figure 7:
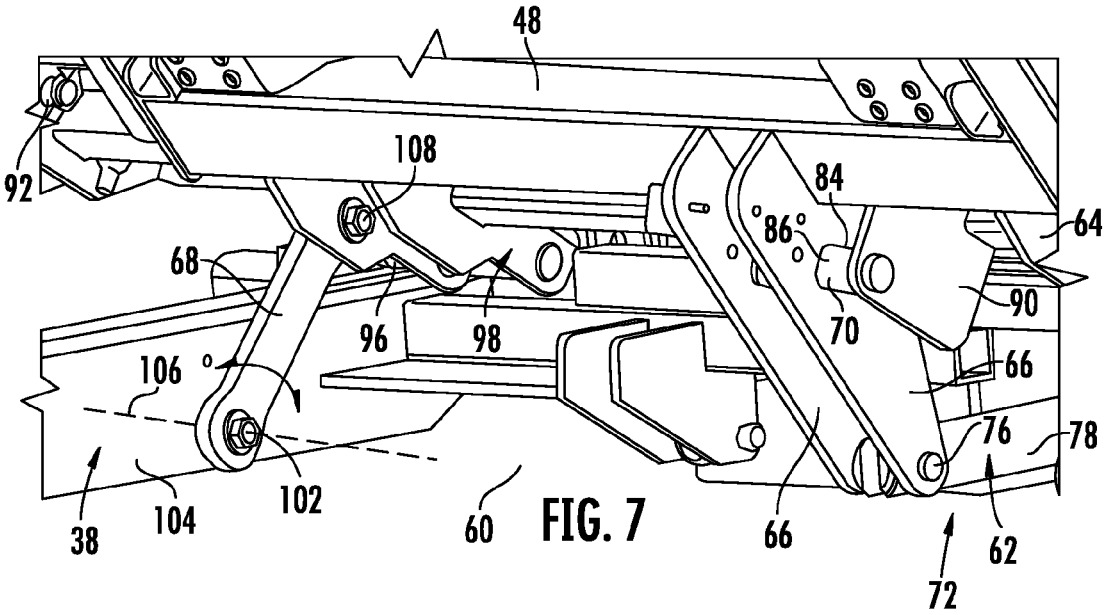
FIG. 7 is a perspective view of the pivoting assembly of FIG. 2 shown from a first perspective.
Figure 8:
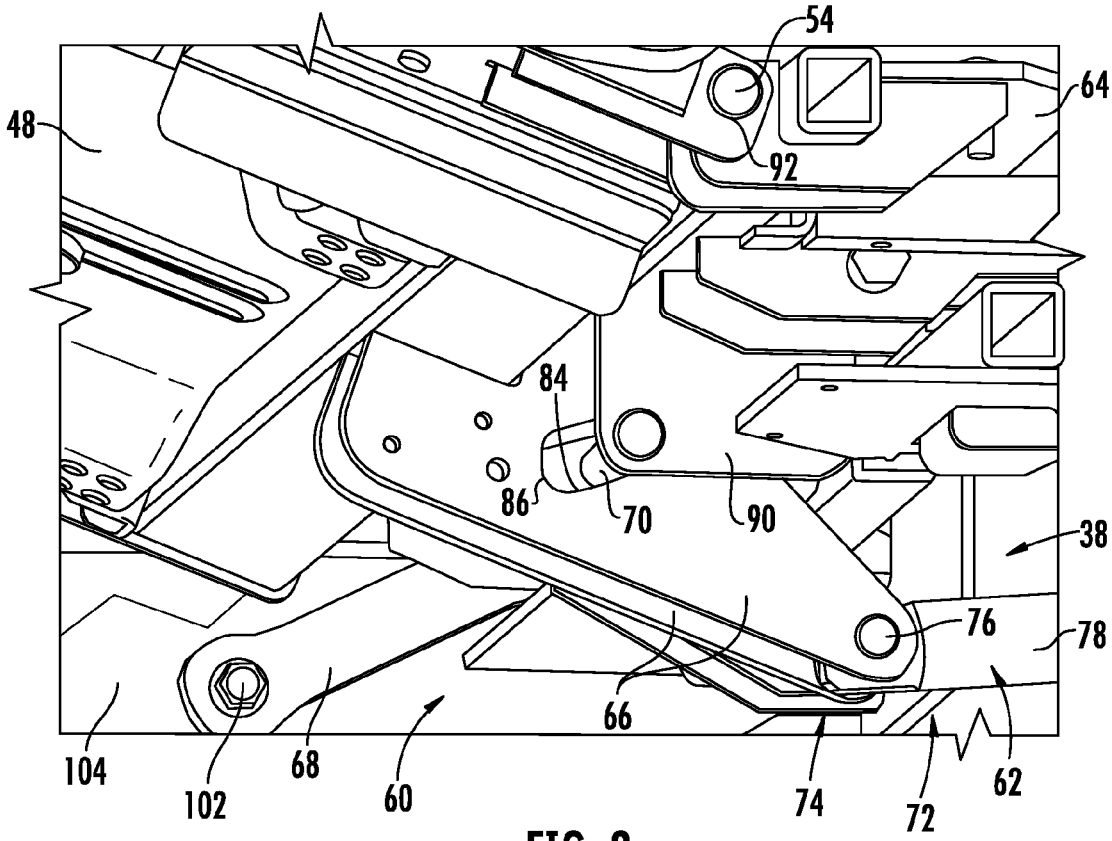
FIG. 8 is a perspective view of the pivoting assembly of FIG. 2 shown from a second perspective different from the first perspective of FIG. 7.

As was noted above, pivot assembly 60 also includes a pair of links 68 (one shown in FIGS. 7 and 8). Each link 68 is attached along a side of frame 38. FIGS. 7 and 8 illustrate more clearly the attachment of one of the links 68 to frame 38 and intermediate section 64. The manner in which the other link 68 (not shown in FIGS. 7 and 8) operates and attaches to frame 38 and intermediate section 64 is identical to that of the link 68 shown in FIGS. 7 and 8. Accordingly, it will only be necessary to describe the connections and operations of one link 68. As can be seen more clearly in FIG. 7, link 68 is rotatably coupled via a pin 102 to a side beam 104 of frame 38. Link 68 is thus free to rotate about a horizontal pivot axis 106 in the direction generally indicated in FIG. 7. An opposite end of link 68 is rotatably coupled via a pin 108 to an underside of intermediate deck section 64. Each link 68 thus helps guide and support intermediate deck section 64 as it moves.

Figure 9:
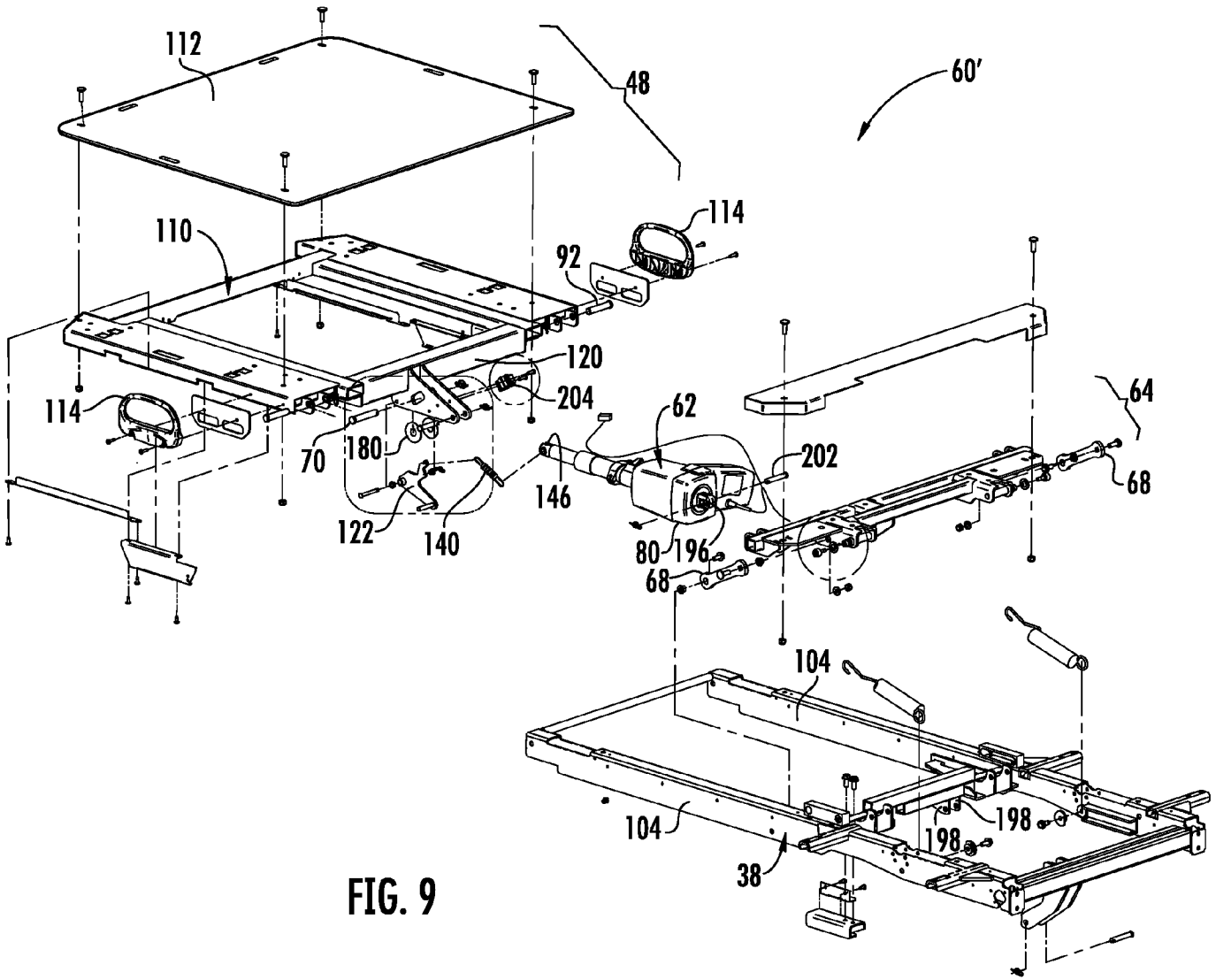
FIG. 9 is an exploded, perspective view of various components of a patient support apparatus, including a pivoting assembly according to a second embodiment of the present invention.

FIGS. 9-22 illustrate a pivot assembly 60' according to another aspect of the present invention. All of the components of pivot assembly 60' that are the same as those of pivot assembly 60 and that operate in a similar manner have been labeled in FIGS. 9-22 with the same reference numerals as given in FIGS. 1-8. Accordingly, no new labels or descriptions will be given to those items of pivot assembly 60' that have already been labeled and described with respect to pivot assembly 60. An exploded, perspective view of pivot assembly 60', as well as various structures of frame 38, is illustrated in FIG. 9. In general, pivot assembly 60' includes an actuator 62, an intermediate deck section 64, a plurality of extensions 66 (FIG. 15), a pair of links 68 (FIG. 11), and a stopper or pin 70. Pivot assembly 60' interconnects head section 48 with a seat section 50 (not shown in FIGS. 9-22) in a manner similar to that described above with respect to pivot assembly 60. More specifically, pivot assembly 60' enables head section 48 to pivot about a pivot axis 54 (FIG. 10) from a horizontal orientation to a raised orientation while passing through an intermediate orientation 82. After head section 48 has reached the intermediate orientation 82, pivot assembly 60' causes pivot axis 54 to move in a similar manner to that described above with respect to pivot assembly 60 as head section 48 pivots upwardly from intermediate orientation 82.

Figure 10:
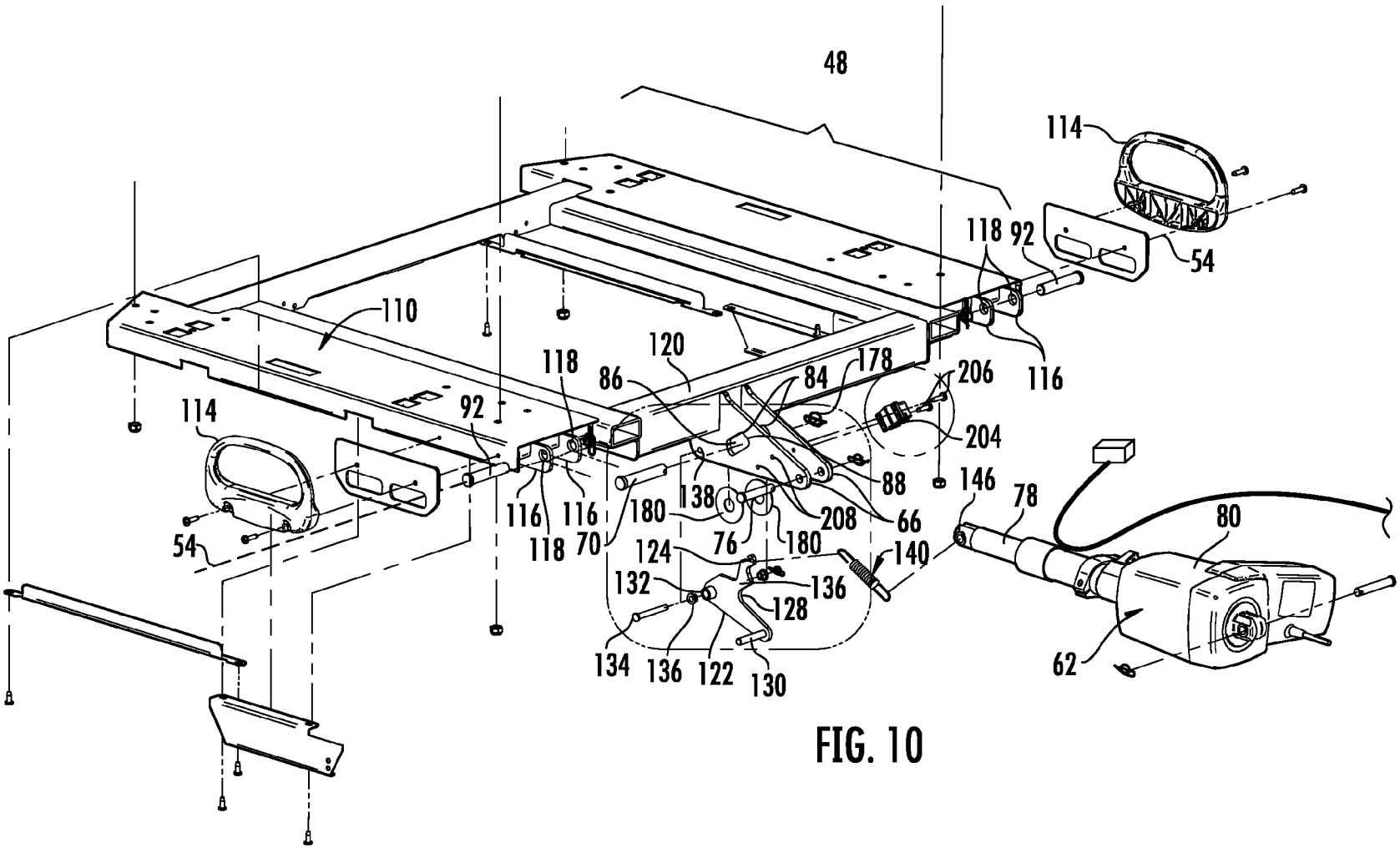
FIG. 10 is an exploded, perspective view of a head deck section and the pivoting assembly of FIG. 9.
Figure 15:
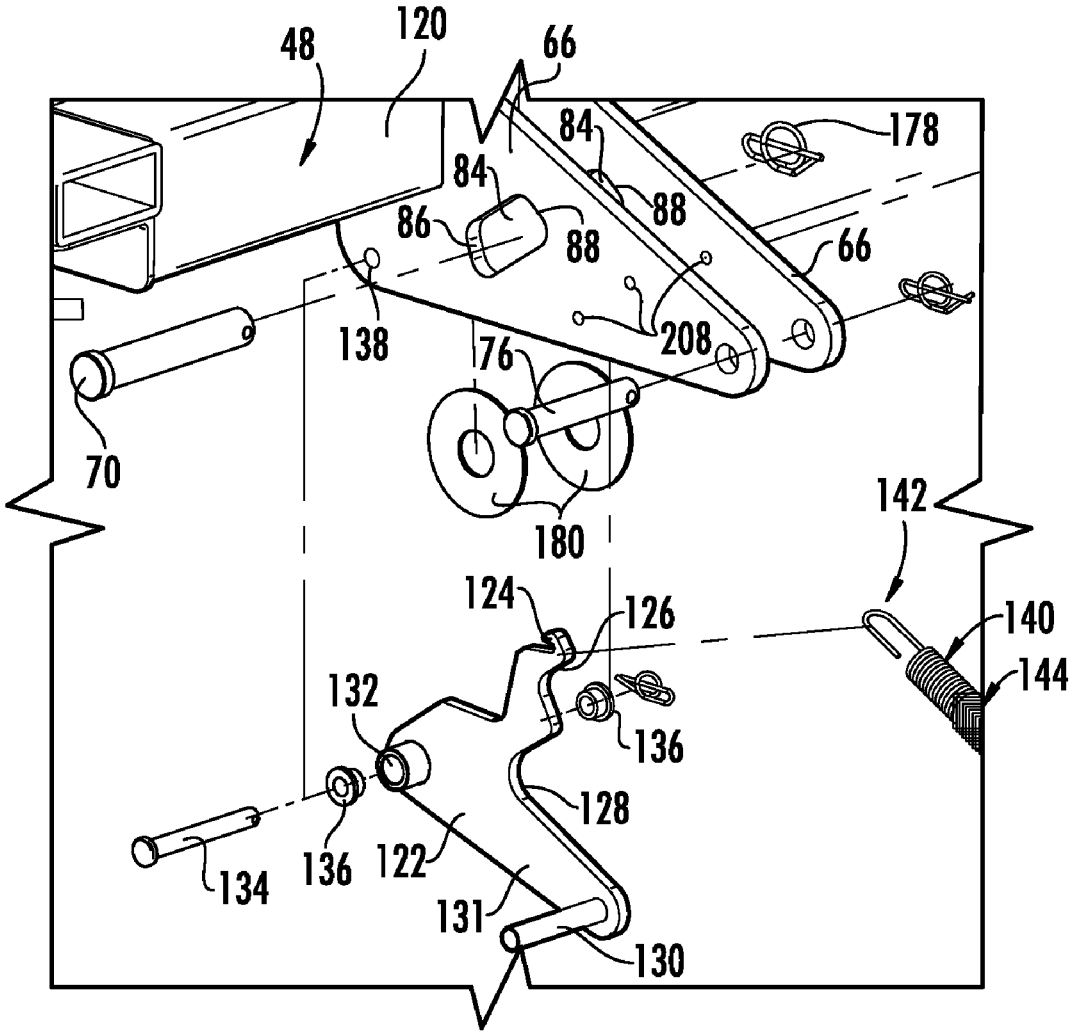
FIG. 15 is a close-up perspective view of a portion of the pivoting assembly illustrated in FIG. 9 and labeled Detail B.
Figure 16:
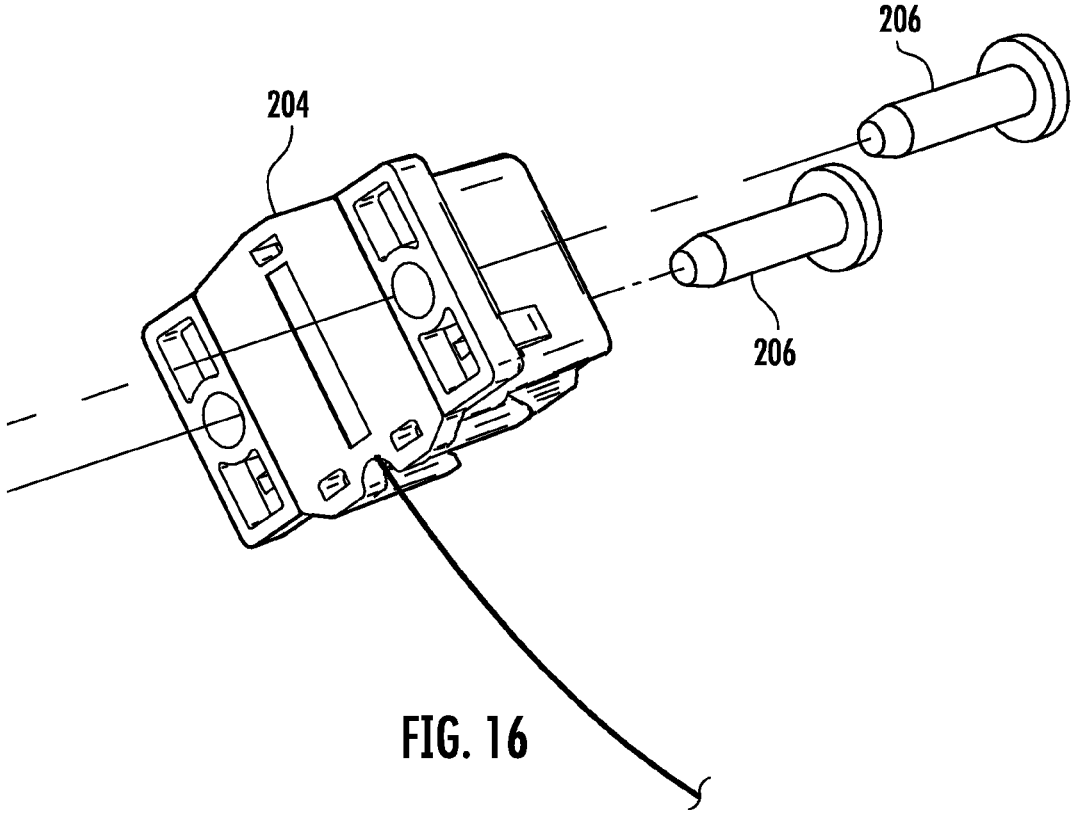
FIG. 16 is an enlarged, perspective view of a sensor that is also illustrated in FIG. 9.

One manner of constructing head section 48 of deck 40 is illustrated in more detail in FIGS. 9 and 10. As can be seen therein, head section 48 includes a frame 110 to which may be mounted a support plate 112 (FIG. 9). Head section 48 further includes a pair of handles 114 mounted on either side of head section 48. A pair of flanges 116 (FIG. 10) define a set of apertures 118 through which pins 92 are inserted. Extensions 66 are fixedly secured to a crossbar 120 of head section 48. Extensions 66 include slots 84 defined therein having head and foot edges 86 and 88, respectively (FIG. 15). Extensions 66 attach to actuator 62 via a pin 76, as has already been discussed above with respect to pivot assembly 60. As is illustrated more clearly in FIGS. 10 and 15, pivot assembly 60' includes, in addition to those items already mentioned, a finger member 122. Finger member 122 includes a hook 124, a first recess 126 (FIG. 15), a second recess 128, a low friction member 130 attached to a lever arm 131, and a pivot aperture 132. Finger member 122 sits between each extension 66 in a manner that is more clearly illustrated in FIGS. 20-22. Finger member 122 is rotatably attached to extension 66 by way of a pin 134 and a pair of bushings 136. Pin 134 fits through pivot aperture 132 of finger member 122, as well as a pivot aperture 138 defined in each of extensions 66.

Pivot assembly 60' further includes a spring 140 (FIG. 10) having a head end 142 and a foot end 144. Head end 142 of spring 140 attaches to hook 124 of finger member 122. Foot end 144 of spring 140 attaches to pin 76. Pin 76, as described with respect to pivot assembly 60, attaches actuator 62 to extensions 66. Spring 140 exerts a biasing force against finger member 122 that urges finger member 122 to rotate about pin 134 in a generally clockwise direction as viewed in FIG. 15.

Figure 12:
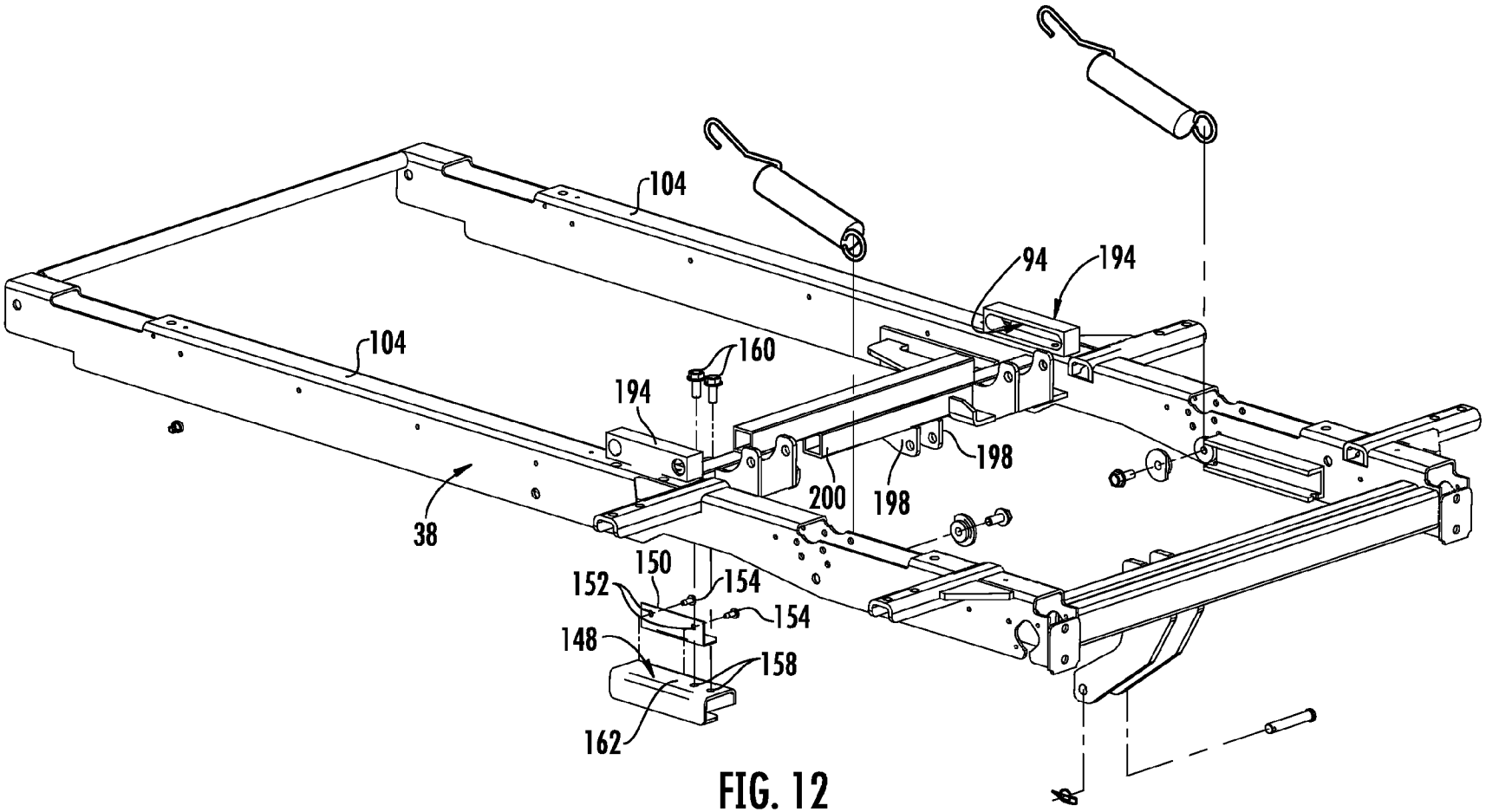
FIG. 12 is an enlarged perspective view of a patient support apparatus frame that is also illustrated in FIG. 9.

Actuator 62 includes an aperture 146 defined at a distal end of telescoping member 78 (FIG. 10). Aperture 146 receives pin 76. Pin 76 rotatably couples telescoping member 78 of actuator 62 to extensions 66. When head section 48 is pivoted upwardly from the horizontal orientation, low friction member 130 of finger member 122 moves along an abutment 148, which may be seen more clearly in FIGS. 12 and 17-22. Low friction member 130 may include a roller rotatably coupled thereon (not shown) that enables it to ride more easily along abutment 148, or such roller may be omitted. Abutment 148 is fixedly secured to one of the side beams 104 of frame 38 (FIG. 12). Abutment 148 is secured to side beam 104 by way of a bracket 150. Bracket 150 includes a pair of attachment apertures 152 which receive corresponding screws 154 for securing bracket 150 to side member 104. Bracket 150 includes another pair of apertures (not shown) that are aligned with a pair of apertures 158 defined in abutment 148. A pair of bolts 160 are inserted through apertures 158 (and those of bracket 150) to thereby secure bracket 150 and abutment 148 to side member 104. Abutment 148 includes a top surface 162 (FIG. 12) which is engaged by low friction member 130.

Figure 11:
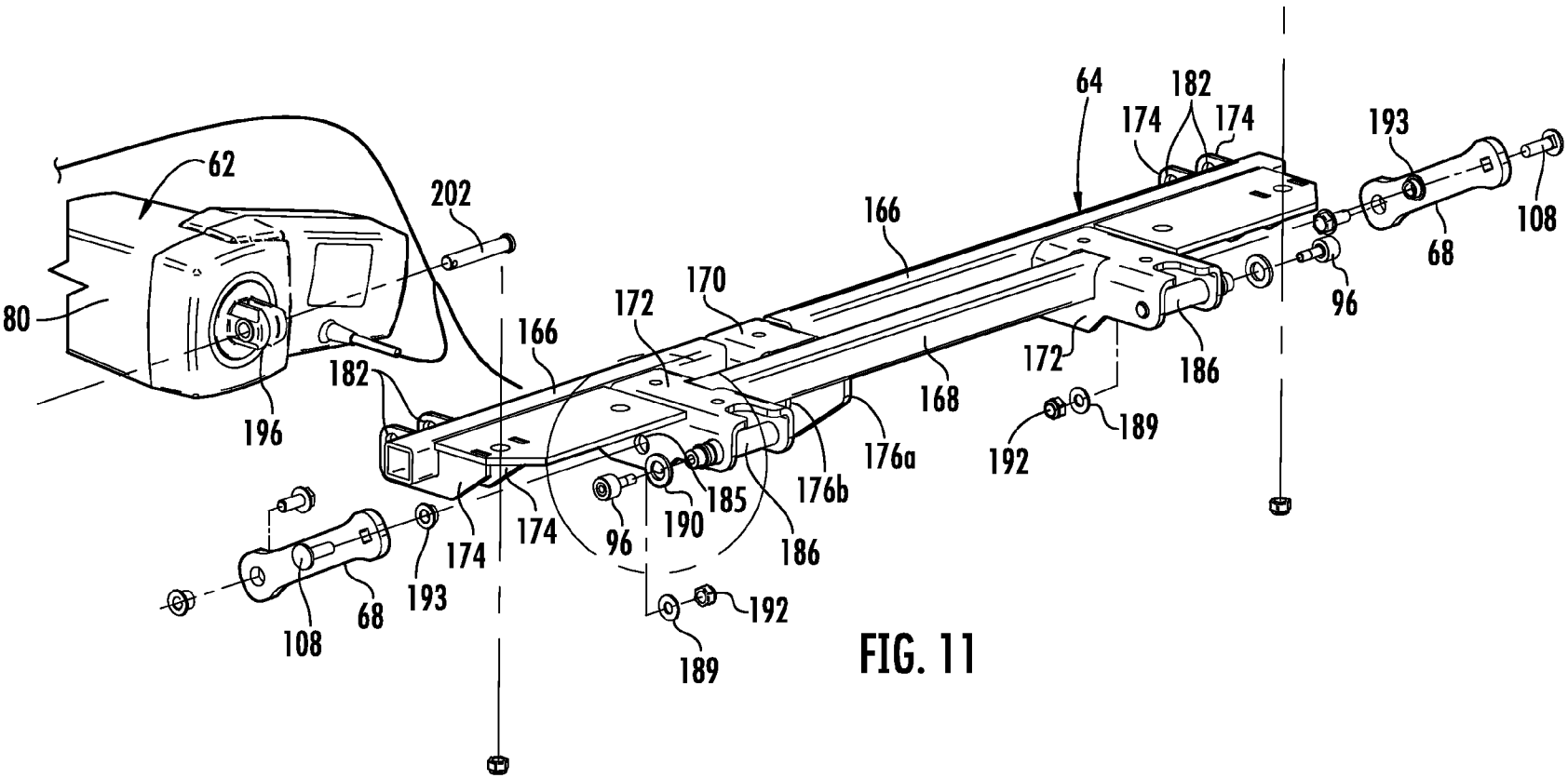
FIG. 11 is an enlarged, exploded, perspective view of an intermediate deck section that is also illustrated in FIG. 9.

Intermediate deck section 64 is illustrated in more detail in FIG. 11. Intermediate deck section 64 includes a pair of head end crossbars 166, a foot end crossbar 168, an inverted U-shaped member 170 positioned between each of the head end crossbars 166, a pair of inner brackets 172, and two sets of outer brackets 174. Inverted U-shaped member 170 includes a pair of sidewalls **176*a* and 176*b*. While not illustrated in FIG. 11, sidewalls 176*a* and 176*b* of inverted U-shaped member 170 each include an aperture through which stopper 70 is inserted. These apertures are dimensioned to be approximately the same size as the circumference of stopper 70. Thus, when a clip 178 (FIG. 10) is attached to stopper 70 after stopper 70 has been inserted through the apertures in sidewalls 176*a* and 176*b*, stopper 70 becomes fixedly secured to intermediate deck section 64. In addition to passing through the apertures of sidewalls 176*a* and b, stopper 70 also passes through slots 84 in extensions 66 and a pair of washers 180 positioned between each of extensions 66**.

The two sets of outer brackets 174 of intermediate deck section 64 each include apertures 182 (FIG. 11). A first pin 92 (FIG. 10) passes through a pair of these apertures 182 on a first side of deck section 64, and a second pin 92 passes though a pair of these apertures 182 on the opposite side of intermediate section 64. Each pin 92 also passes through the pair of apertures 118 defined on each side of head section 48 (FIG. 10). Thus, intermediate deck section 64 and head section 48 are pivotally linked via pins 92 passing through apertures 182 and 118.

Inner brackets 172 each include an aperture 185 (FIG. 11) which receives pin 108 that pivotably secures link 68 to intermediate deck section 64. Pins 108 may be secured through apertures 185 by way of a washer 189 and a nut 192. A bushing 193 may also be partially inserted into apertures 185 on the link 68 side of apertures 185.

Inner brackets 172 of intermediate deck section 64 also each include a horizontal tube 186 (FIG. 11) to which roller 96 is rollingly coupled. A washer 190 is inserted between roller 96 and tube 186. Rollers 96 slide in tracks 94 attached to frame 38. As can be seen in more detail in FIGS. 12 and 13, frame 38 includes a pair of track members 194 fixedly attached to a top surface of each of side beams 104. Track members 194 define tracks 94, in which rollers 96 roll.

Figure 13:
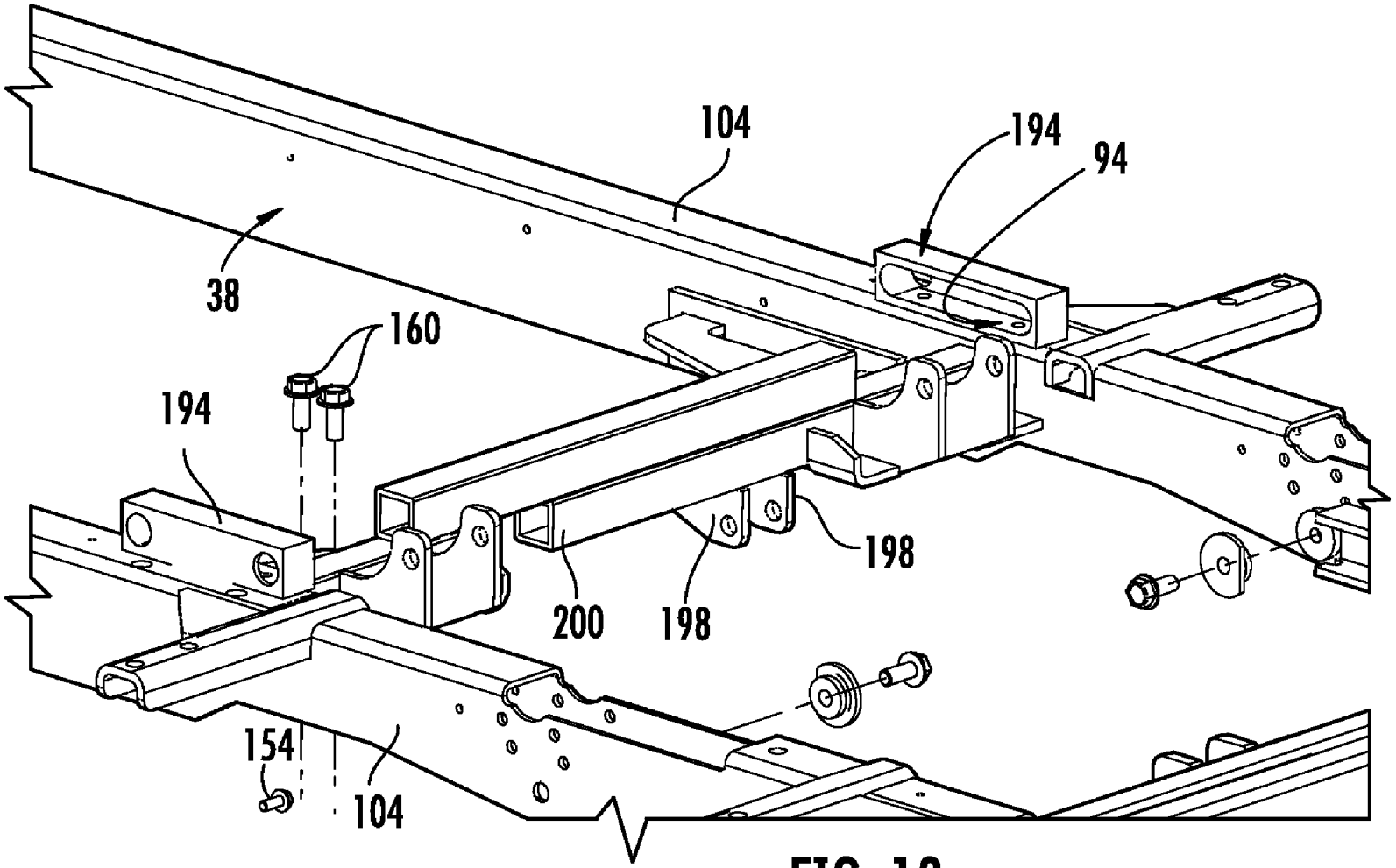
FIG. 13 is a close-up, perspective view of a central region of the patient support apparatus frame of FIG. 12.
Figure 14:
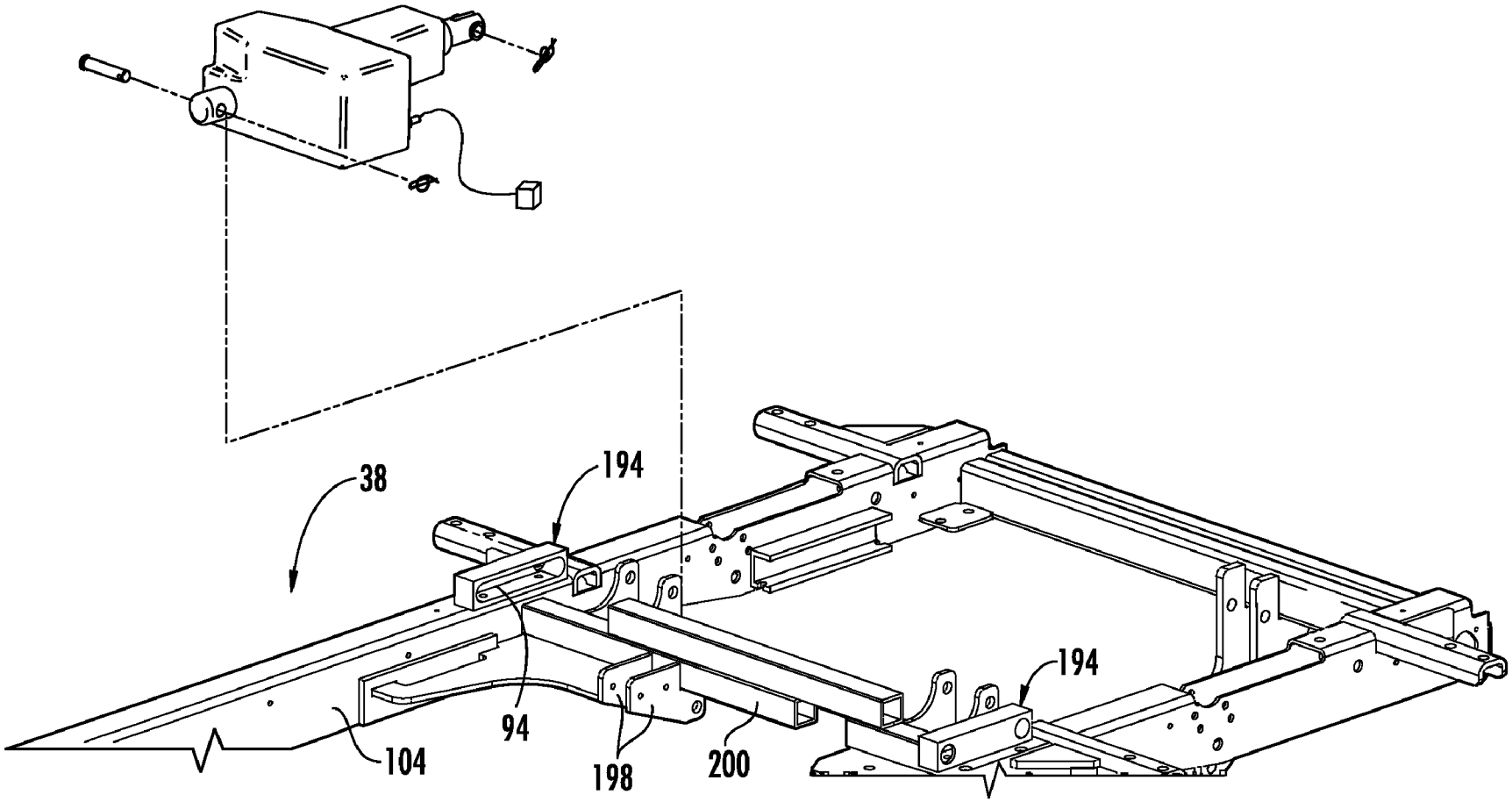
FIG. 14 is a perspective view of the central region of the frame of FIG. 13 shown from a different perspective from that of FIG. 13.

Actuator 62 includes a foot end 196 (FIG. 11) that is pivotally coupled to a pair of vertical flanges 198 attached to an underside of a frame crossbar 200 (FIG. 13). A pin 202 (FIG. 9) is inserted through apertures defined in flanges 198 and a corresponding aperture in the foot end 196 of actuator 62. Pin 202 thereby pivotally secures actuator 62 to flanges 198 of crossbar 200.

A sensor 204 (FIGS. 10 and 16) may be attached to extension 66 by way of a pair of pins 206 that are received in corresponding pin apertures 208 (FIG. 15) defined in extensions 66. Sensor 204 detects its angular orientation with respect to horizontal. Because sensor 204 is mounted to extensions 66, which in turn are mounted to head section 48, sensor 204 will detect the angular orientation of head section 48 with respect to horizontal. Sensor 204 may be any conventional sensor capable of detecting an angle with respect to horizontal. Such sensors include accelerometers, inclinometers, inertial sensors, or any other type of sensor capable of detecting an angular deviation from a horizontal orientation. Sensor 204 may also be a sensor that detects an angular orientation of head section 48 relative to another component of patient support apparatus 30, such as frame 38. When sensor 204 detects such a relative orientation, the actual angle of head section 48 with respect to horizontal may be slightly different than the reading output by sensor 204 because patient support apparatus 30 may be positioned on a floor that is not horizontal. Such a relative orientation of head section 48 may desirably be used in some versions of support apparatus 30 instead of an absolute measurement with respect to true horizontal. The output of sensor 204, whether an absolute or relative measure, may be fed to an electronic controller positioned on patient support apparatus 30 (not shown) or transmitted to a memory or processor located off of patient support apparatus 30. If the output is sent to a processor on patient support apparatus 30, it may then be displayed on a display positioned at a convenient location on patient support apparatus 30.

Figure 17:
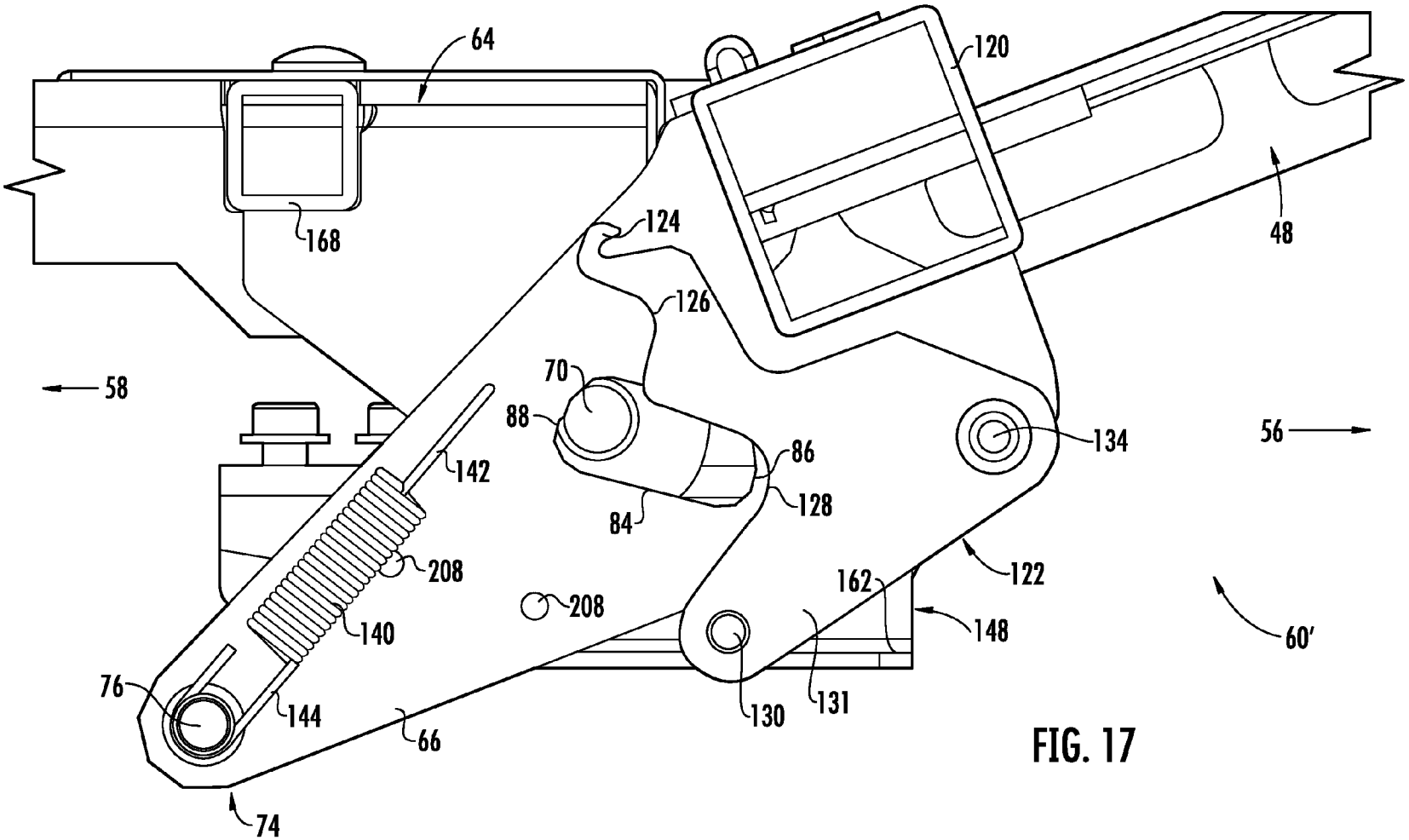
FIG. 17 is a side, sectional view of the pivoting assembly of FIG. 9 taken along a vertical plane intersecting the patient support apparatus between a pair of head section extensions, the pivoting assembly shown pivoted to an angle of approximately ten degrees.
Figure 18:
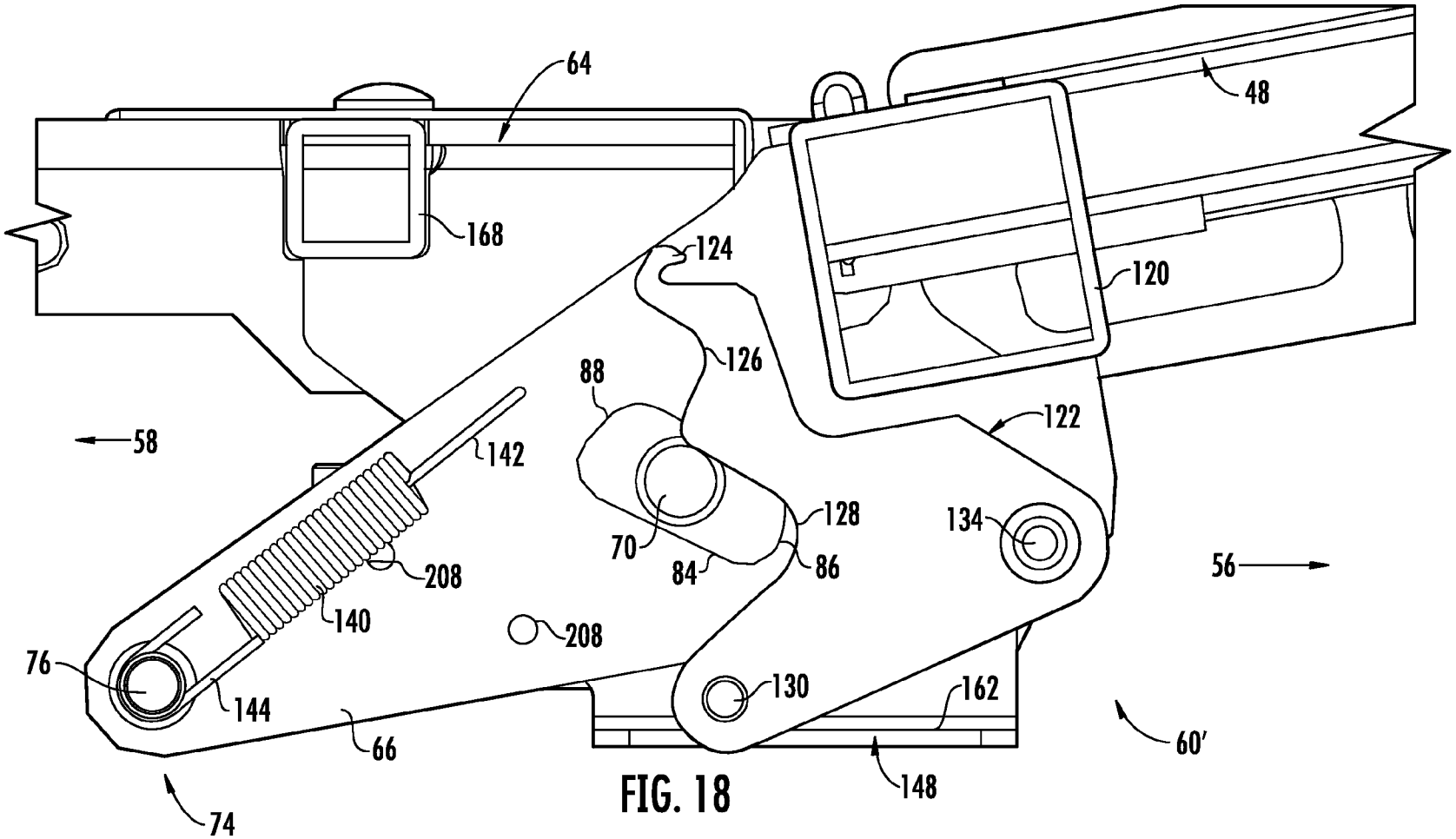
FIG. 18 is a side, sectional view similar to FIG. 17 illustrating the pivoting assembly pivoted to an angle of approximately twenty degrees.
Figure 19:
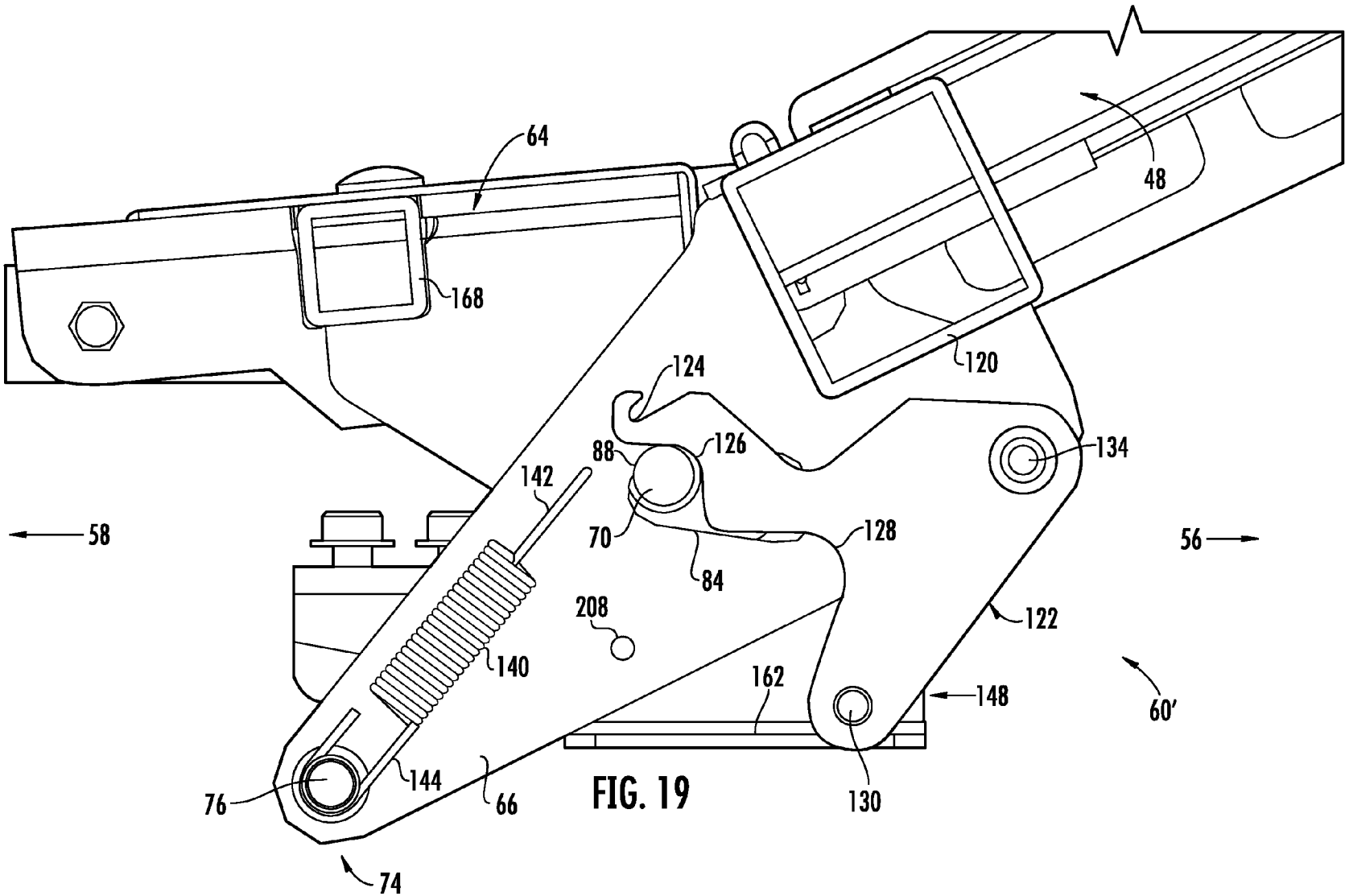
FIG. 19 is a side, sectional view similar to FIG. 17 illustrating the pivoting assembly pivoted to an angle of approximately twenty-five degrees.
Figure 20:
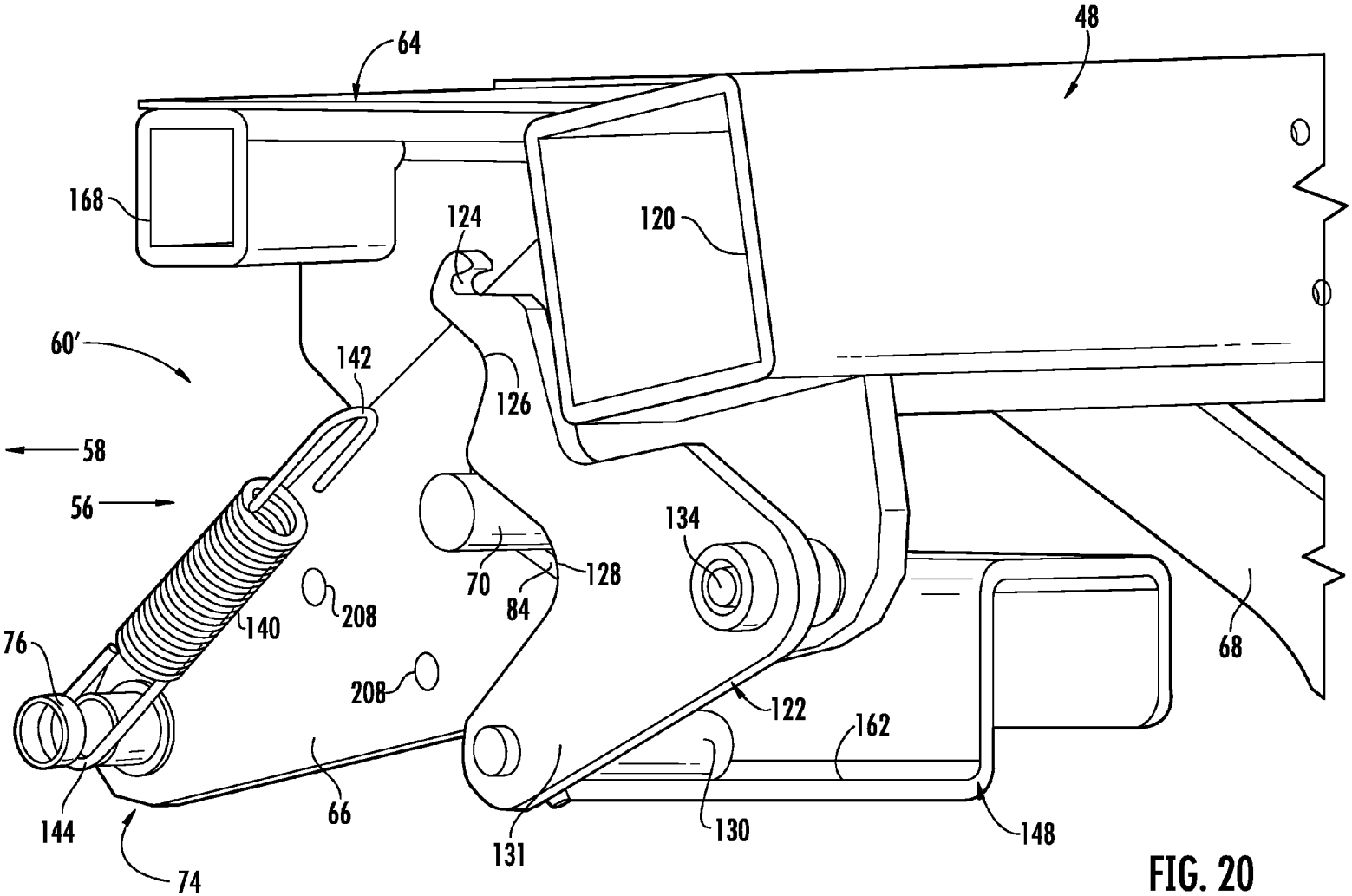
FIG. 20 is a perspective view of the region of the pivoting assembly shown in FIG. 17 wherein the pivoting assembly is shown pivoted to an angle of approximately ten degrees.
Figure 21:
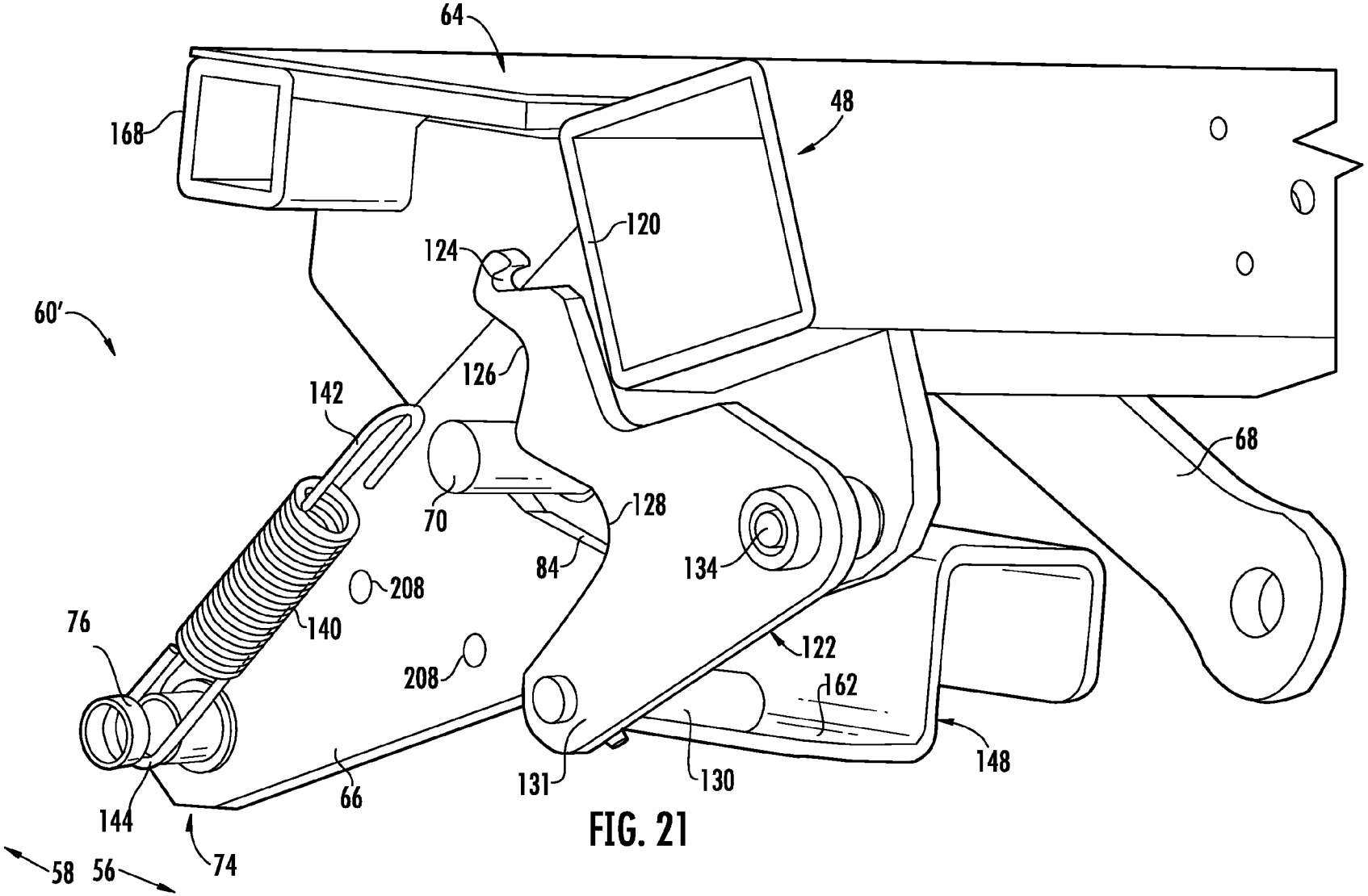
FIG. 21 is a perspective view similar to FIG. 20 illustrating the pivoting assembly pivoted to an angle of approximately twenty degrees.
Figure 22:
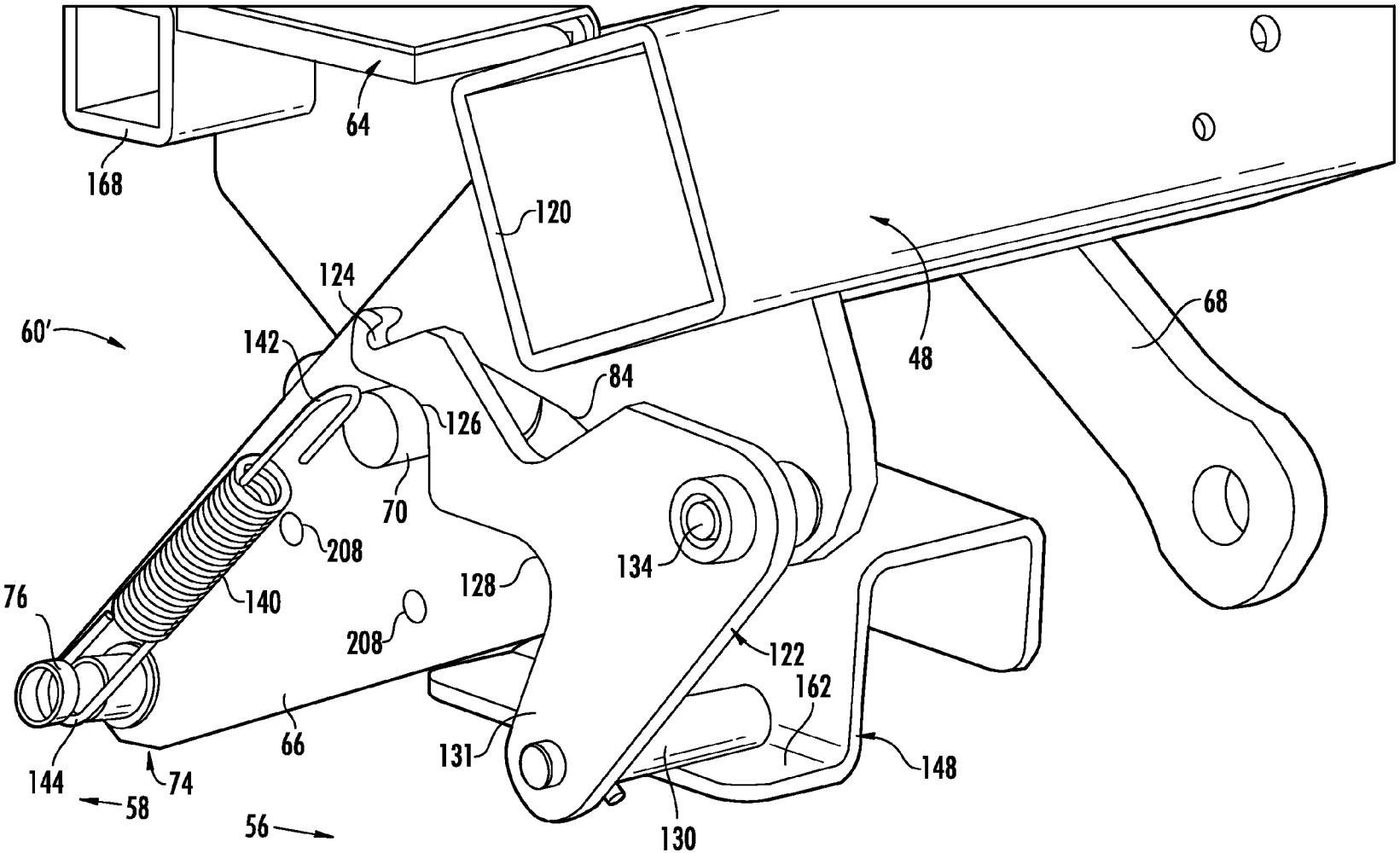
FIG. 22 is a perspective view similar to FIG. 20 illustrating the pivoting assembly pivoted to an angle of approximately twenty-five degrees.

The manner in which pivot assembly 60 operates as head section 48 is pivoted upwardly from a horizontal orientation is depicted in more detail in FIGS. 17-22. FIGS. 17, 18, and 19 depict a side, cross-sectional view of pivot assembly 60' after it has been rotated to 10 degrees, 20 degrees, and 25 degrees, respectively. FIGS. 20-22 illustrate perspective views of pivot assembly 60' after it has been rotated upwardly from the horizontal orientation to angles of 10 degrees, 20 degrees, and 25 degrees, respectively. While head end 142 of spring 140 is illustrated in FIGS. 17-22 as not being connected to any structure, it will be understood that this has been done merely for purposes of illustration. In actuality, head end 142 of spring 140 is hooked around hook 124 of finger member 122. Spring 140 is connected to hook 124 at all orientations of head section 148, including the horizontal orientation. Spring 140 exerts a biasing force against finger member 122, which in turn urges low friction member 130 against top surface 162 of abutment 148. This causes rotation of finger member 122 as head section 48 is pivoted upwardly. When head section 48 has been pivoted to within the vicinity of intermediate orientation 82, finger member 122 is urged by spring 140 into a position in which stopper 70 generally fits within first recess 126. The movement of finger member 122 into this orientation generally shortens the length of slots 84 such that stopper 70 is more tightly constrained within slots 84. This reduces the amount of leeway between head section 48 and intermediate deck section 64. Any looseness in head section 48 after it has been pivoted past intermediate orientation 82 is thereby reduced or eliminated via finger member 122. Stated in another manner finger 122 effectively shortens the length of slots 84 after intermediate orientation 82 has been reached.

The interaction of finger 122 with stopper 70 serves to lock the angular orientation of intermediate section 64 with respect to head section 48. More specifically, after head section 48 has been pivoted to intermediate orientation 82, any further upward pivoting of head section 48 will cause head end 100 of intermediate section 64 to also pivot upwardly, as was explained previously. The interaction of finger 122 with stopper 70 helps ensure that head section 48 and intermediate section 64 maintain the same angular orientation with respect to each other as they both continue to pivot further upwardly. The interaction of finger 122 with stopper 70 creates a sufficiently rigid interconnection between head section 48 and intermediate section 64 such that even significant downward forces applied against head section 48 will not disturb the angular orientation of head section 48 with respect to intermediate section 64. This is particularly true as head section 48 pivots upwardly past intermediate orientation 82, and also true, though to a somewhat lesser extent, as head section 48 pivots downwardly toward intermediate orientation 82.

It will be understood that the present invention is applicable to a variety of different patient support apparatuses that are differently configured than that illustrated in FIG. 1. For example, while FIG. 1 depicts a patient support apparatus 30 having three deck sections, it will be understood that the present invention is applicable to patient support apparatuses having different numbers of deck sections. The pivot assemblies 60 and 60' of the present invention can be applied to patient support apparatuses having separate seat and foot sections of the deck 40, or patient support apparatuses having only a seat section or only a foot section of deck 40. Still further, the pivot assemblies of the present invention can be applied to patient support apparatuses in which seat section 50 or foot section 52, or both, are pivotable to orientations other than horizontal. In general, pivot assemblies 60 and 60' of the present invention are applicable to any patient support apparatuses having a pivotable head section.

While the present invention has been described herein in terms of the several embodiments illustrated in the attached drawings, it will be understood by those skilled in the art that the present invention can be modified to include any and all variations that are within the spirit and scope of the following claims.

What is claimed is:

1. A patient support apparatus comprising:

a frame;

a deck supported by said frame and configured to support a patient, said deck having a foot end and a head end, said deck including a head section oriented adjacent said head end of said deck, and a second section oriented adjacent said head section;

a pivot axis about which said head section is able to pivot from a generally horizontal orientation to an intermediate orientation defining a first angle with respect to said horizontal orientation, and from said intermediate orientation to a raised orientation defining a second angle with respect to said horizontal orientation, said second angle being greater than said first angle; and an actuator coupled to said frame and said head section, said actuator adapted to pivot said head section about said pivot axis from said generally horizontal orientation to said raised orientation, wherein said pivot axis remains stationary with respect to said frame while said head section pivots from said generally horizontal orientation to said intermediate orientation, and said pivot axis moves with respect to said frame while said head section pivots from said intermediate orientation to said raised orientation; and wherein said pivot axis moves upwardly from said frame as said head section is pivoted from said intermediate orientation to said raised orientation, and said pivot axis also moves away from said second section in a direction oriented toward said head end of said deck as said head section is pivoted from said intermediate orientation to said raised orientation.

2. The patient support apparatus of claim 1 wherein said first angle is between 15 and 50 degrees.

3. The patient support apparatus of claim 1 wherein said deck further includes an intermediate section positioned between said head section and said second section, said intermediate section having a head end and a foot end, said intermediate section being configured to remain in a generally horizontal orientation as said head section is pivoted from said generally horizontal orientation to said intermediate orientation, and said intermediate section also being configured such that said head end of said intermediate section pivots upwardly away from said frame as said head section pivots from said intermediate orientation to said raised orientation.

4. The patient support apparatus of claim 3 wherein said intermediate section includes a foot end configured to translate linearly away from said second section in a generally horizontal direction pointing toward said head end of said deck as said head section is pivoted from said intermediate orientation to said raised orientation.

5. The patient support apparatus of claim 4 wherein said intermediate section includes a head end configured to move vertically upward from said frame and horizontally toward said head end as said head section is pivoted from said intermediate orientation to said raised orientation.

6. The patient support apparatus of claim 4 wherein said intermediate section includes a plurality of rollers and said frame includes a plurality of tracks, said rollers adapted to roll in said tracks as said head section is pivoted from said intermediate orientation to said raised orientation.

7. The patient support apparatus of claim 3 further including:

an extension attached to a foot end of said head section, said extension having a slot defined therein, said slot including a plurality of edges; and a pin attached to said intermediate section, said pin being positioned in said slot such that at least one of said plurality of edges causes said pin to move with respect to said frame when said head section pivots between said intermediate orientation and said raised orientation.

8. The patient support apparatus of claim 7 wherein when said pin moves with respect to said frame, said pin causes a foot end of said intermediate section to translate linearly away from said second section in a generally horizontal direction pointing toward said head end of said deck as said head section is pivoted from said intermediate orientation to said raised orientation.

9. The patient support apparatus of claim 3 further including a plurality of links, each said link having a first end rotatably coupled to said frame and a second end rotatably coupled to said intermediate section.

10. The patient support apparatus of claim 9 wherein said second end of said links are rotatably coupled to a location on an underside of said intermediate section, said location also being located generally midway between a head end and a foot end of said intermediate section.

11. The patient support apparatus of claim 1 wherein said actuator includes a telescoping structure and said actuator is attached to said head section such that a length of said telescoping section expands as said head section is pivoted from said generally horizontal orientation to said intermediate orientation.

12. The patient support apparatus of claim 1 wherein said actuator is coupled to said head section by a spring.

13. The patient support apparatus of claim 1 wherein said patient support apparatus is a hospital bed.

14. The patient support apparatus of claim 13 wherein said hospital bed includes a base having a plurality of wheels, and an elevation mechanism coupled between said base and said deck whereby said elevation mechanism is adapted to raise and lower said deck section with respect to said base section.

15. The patient support apparatus of claim 1 further including a sensor adapted to sense how far said head section has pivoted upwardly from said generally horizontal orientation.

16. The patient support apparatus of claim 1 further including:

an intermediate section of said deck positioned between said head section and said second section;

an extension attached to a foot end of said head section, said extension having a slot defined therein, said slot including a first edge and a second edge opposite said first edge;

a pin attached to said intermediate section, said pin being positioned in said slot such that said first edge comes into contact with said pin only when said head section has been pivoted to said intermediate orientation or said raised orientation or any orientation between said intermediate orientation and said raised orientation.

17. The patient support of claim 16 said wherein said pin has a longitudinal axis generally horizontal and transverse to a direction extending from said head end to said foot end of said patient support.

18. The patient support apparatus of claim 1 further including:

an intermediate section of said deck positioned between said head section and said second section;

a plurality of extensions attached to a foot end of said head section, each extension in said plurality of extensions having a slot defined therein, and each slot including a first edge and a second edge opposite said first edge;

a pin attached to said intermediate section and inserted through at least two of said slots, said pin being positioned in said slot such that said first edges of said at least two slots comes into contact with said pin only when said head section has been pivoted to said intermediate orientation or said raised orientation or any orientation between said intermediate orientation and said raised orientation.

19. The patient support apparatus of claim 18 further including:

an abutment fixed to said frame;

a finger rotatably coupled to at least one of said plurality of extensions, said finger including a lever arm in engagement with said abutment, and said finger including a contact surface positioned to limit a range of movement of said pin within said at least two slots when said head section has been pivoted to said intermediate orientation or said raised orientation or any orientation between said intermediate orientation and said raised orientation.

20. The patient support apparatus of claim 19 wherein said lever arm engages said abutment at different locations along said abutment as said head section pivots from said intermediate orientation to said raised orientation.

21. The patient support apparatus of claim 19 further including a spring coupled to said finger, said spring exerting a biasing force against said finger that urges said finger into contact with said pin when said head section has been pivoted to said intermediate orientation, said raised orientation, or any orientation between said intermediate orientation and said raised orientation.

22. A method of pivoting a head section of a patient support apparatus, said method comprising:

providing a frame;

providing a deck supported by said frame and configured to support a patient, said deck having a foot end and a head end, said deck including a head section oriented adjacent said head end of said deck, and a second section oriented adjacent said head section;

providing a pivot axis about which said head section is able to pivot from a generally horizontal orientation to an intermediate orientation defining a first angle with respect to said horizontal orientation, and from said intermediate orientation to a raised orientation defining a second angle with respect to said horizontal orientation, said second angle being greater than said first angle; and providing an actuator coupled to said frame and said head section, said actuator adapted to pivot said head section about said pivot axis from said generally horizontal orientation to said raised orientation;

maintaining said pivot axis in a stationary position with respect to said frame while said head section pivots from said generally horizontal orientation to said intermediate orientation;

moving said pivot axis with respect to said frame while said head section pivots from said intermediate orientation to said raised orientation;

moving said pivot axis upwardly from said frame as said head section is pivoted from said intermediate orientation to said raised orientation;

moving said pivot axis away from said second section in a direction oriented toward said head end of said deck as said head section is pivoted from said intermediate orientation to said raised orientation.

23. The method of claim 22 further including:

providing an intermediate section positioned between said head section and said second section, said intermediate section having a head end and a foot end;

maintaining said intermediate section in a generally horizontal orientation as said head section is pivoted from said generally horizontal orientation to said intermediate orientation;

pivoting said head end of said intermediate section upwardly away from said frame as said head section pivots from said intermediate orientation to said raised orientation.

* * * * *